US011633772B2

(12) United States Patent
Kubo et al.

(10) Patent No.: US 11,633,772 B2
(45) Date of Patent: Apr. 25, 2023

(54) HOT PRESS-FORMED ITEM MANUFACTURING METHOD, PRESS-FORMED ITEM, DIE, AND DIE SET

(71) Applicant: NIPPON STEEL CORPORATION, Tokyo (JP)

(72) Inventors: Masahiro Kubo, Tokyo (JP); Naruhiko Nomura, Tokyo (JP); Toshiya Suzuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/059,987

(22) PCT Filed: Jul. 3, 2019

(86) PCT No.: PCT/JP2019/026535
§ 371 (c)(1),
(2) Date: Nov. 30, 2020

(87) PCT Pub. No.: WO2020/009170
PCT Pub. Date: Jan. 9, 2020

(65) Prior Publication Data

US 2021/0220895 A1 Jul. 22, 2021

(30) Foreign Application Priority Data

Jul. 4, 2018 (JP) ..... JP2018-127892

(51) Int. Cl.
*B21D 22/02* (2006.01)
*B21D 37/10* (2006.01)
(Continued)

(52) U.S. Cl.
CPC ..... *B21D 22/022* (2013.01); *B21D 37/10* (2013.01)

(58) Field of Classification Search
CPC ..... B21D 22/022; B21D 37/10; B21D 37/00; B21D 37/01; B21D 37/20
See application file for complete search history.

(56) References Cited

U.S. PATENT DOCUMENTS

2011/0030441 A1 2/2011 Maki et al.
2015/0020562 A1 1/2015 Yamanaka et al.
(Continued)

FOREIGN PATENT DOCUMENTS

CN 111936248 A 11/2020
JP 5-115930 A 5/1993
(Continued)

OTHER PUBLICATIONS

English translate (JP2005305510A), retrieved date Aug. 16, 2022.*
(Continued)

*Primary Examiner* — Shelley M Self
*Assistant Examiner* — Mohammed S. Alawadi
(74) *Attorney, Agent, or Firm* — Solaaris Intellectual Property Group, PLLC

(57) ABSTRACT

A method of producing a hot press-formed product, in which a die includes a hard layer having a skewness (Rsk), as measured in a direction from the outside of a die hole toward an inside of the die hole, of from −5.0 to 1.2, and a hardness Hv_Die of from HV 1,000 to 1,800, over the entirety of a region of a steel sheet contact surface that is adjacent to a die shoulder portion. The steel sheet contact surface is a surface located outside of the die hole and configured to contact a hot-dip galvannealed steel sheet that is to be subjected to hot press forming.

11 Claims, 7 Drawing Sheets

(51) Int. Cl.
*B21D 22/20* (2006.01)
*B21D 53/88* (2006.01)

(56) References Cited

U.S. PATENT DOCUMENTS

| | | | | |
|---|---|---|---|---|
| 2015/0354035 | A1* | 12/2015 | Mizuta | C21D 8/005 148/504 |
| 2017/0036259 | A1* | 2/2017 | Yamamoto | C23C 14/34 |
| 2017/0043386 | A1* | 2/2017 | Nakagaito | B21D 37/16 |
| 2017/0165737 | A1* | 6/2017 | Yamamoto | C23C 30/00 |
| 2018/0141102 | A1* | 5/2018 | Honda | B21J 13/02 |
| 2021/0114074 | A1 | 4/2021 | Kubo et al. | |

FOREIGN PATENT DOCUMENTS

| | | | |
|---|---|---|---|
| JP | 2005-305510 | A | 11/2005 |
| JP | 2005305510 | A * | 11/2005 |
| JP | 2014-139350 | A | 7/2014 |
| JP | 2015-205328 | A | 11/2015 |
| WO | WO 2009/131233 | A1 | 10/2009 |
| WO | WO 2016/171273 | A1 | 10/2016 |
| WO | 2017/029773 | A1 | 2/2017 |

OTHER PUBLICATIONS

Hardening Steel by Nitriding, retrieved date Aug. 16, 2022. http://www.seetobago.org/trinidad/pan/archive/r&d/panart/ir_archivecopy_hardening_steel_by_nitriding.htm.*

Nitriding Steel—an overview _ ScienceDirect Topics, retrieved date Aug. 16, 2022. https://www.sciencedirect.com/topics/materials-science/nitriding-steel.*

International Search Report for PCT/JP2019/026535 dated Sep. 17, 2019.

* cited by examiner

HOT PRESS-FORMED ITEM MANUFACTURING METHOD, PRESS-FORMED ITEM, DIE, AND DIE SET

TECHNICAL FIELD

The present disclosure relates to a method of producing a hot press-formed product, a press-formed product, a die, and a die set.

BACKGROUND ART

In recent years, reduction in the consumption of chemical fuels is more strongly requested for protection of environment and prevention of global warming. This request affects various kinds of manufacturing industries. This also applies to automobiles, and, for example, an improvement in fuel efficiency by weight reduction in vehicle body and the like is desired. However, in the case of automobiles, both a weight reduction in vehicle body and safety need to be achieved.

Many of the vehicle structural elements of automobiles are formed of iron, particularly, formed from steel sheets. When reducing the weight of the vehicle body, it is desired to reduce the body weight while maintaining the strength of the structural materials formed from steel sheets. Such a request concerning steel sheets is imposed not only in automobile manufacturing industries, but also in manufacturing industries in various fields, as well. An enhancement in mechanical strength of steel sheets makes it possible to maintain or enhance the mechanical strength of the structural materials, even with a smaller thickness than that of conventionally used steel sheets.

In general, a material having a higher mechanical strength tends to have a lower shape fixability in forming processing, such as bending. In other words, in the case of processing the material to have a complex shape, the processing itself is difficult. Examples of means for solving such a problem associated with formability include a so-called "hot press forming (hot stamping, high-temperature stamping, or die quenching). In hot press forming, a steel sheet, which is an object to be formed, is heated to a high temperature, and the steel sheet softened by the heating is subjected to stamping to perform forming, followed by cooling.

In hot press forming, the steel sheet can easily be stamped since the steel sheet is temporarily softened by being heated to a high temperature. Further, the mechanical strength of the steel sheet can be enhanced by a quenching effect provided by the cooling after the forming. Therefore, using hot press forming, it is possible to obtain a formed product having both a favorable shape fixability and a high mechanical strength.

However, when a steel sheet is heated to a high temperature of 800° C. or higher, surfaces of the steel sheet are oxidized to cause the generation of scales (oxides). In the case of painting or plating a steel sheet in order to ensure corrosion resistance, the presence of scales impede such a treatment. Therefore, after performing the hot press forming, a step (descaling step) of removing the scales is required. In other words, the productivity is poor.

A method that can be used for avoiding the generation of the scales is a method of coating a steel sheet before subjecting the steel sheet to hot press forming. Steel sheets having zinc (Zn)-based plating, which are steel sheets plated with zinc having a sacrificial corrosion-protective effect, are widely used as steel sheets for automobile and the like, due to their corrosion protection performance and steel sheet production technology. However, a heating temperature (a temperature of from 700 to 1,000° C.) in hot press forming is higher than the boiling point of zinc. Therefore, when a steel sheet having Zn-based plating is heated for hot press forming, the plating layer formed on the surface of the steel sheet may evaporate and cause a significant deterioration in surface texture.

Patent Document 1 discloses a method in which a film of a wurtzite-type compound such as a zinc oxide film (hereinafter, also referred to as "ZnO film") is formed on the surface of an Al-plated steel sheet, for the purpose of improving hot lubricity as well as chemical conversion treatability and corrosion resistance, in order to prevent the occurrence of processing defects.

Patent Document 2 discloses a method in which a film made of one or more Zn compounds selected from the group consisting of Zn hydroxide, Zn phosphate, and Zn organic acid is formed on the surface of an Al-plated steel sheet, for the purpose of enhancing the adhesion of a ZnO film during press forming. In the method disclosed in Patent Document 2, a film of ZnO is generated and a ZnO film having an excellent adhesion is formed, by the heat generated when the Al-plated steel sheet provided with the film of the Zn compound(s) is subjected to hot press forming, as a result of which hot lubricity, film adhesion, spot weldability, and corrosion resistance after painting can be improved.

Patent Document 3 discloses a coated mold comprising a hard film on the surface, wherein the hard film includes a layer A composed of a nitride with a film thickness of 5 μm or more, and a layer B composed of a diamond-like carbon film, the layer B is nearer to the outer surface than the layer A is, and the surface of the layer B satisfies the inequalities: the arithmetic mean roughness $Ra \leq 0.2$ μm, the maximum height $Rz \leq 2.0$ μm, and the skewness $Rsk < 0$.

PRIOR ART DOCUMENTS

Patent Documents

Patent Document 1: International Publication (WO) No. 2009/131233

Patent Document 2: Japanese Patent Application Laid-Open (JP-A) No. 2014-139350 A Patent Document 3: International Publication (WO) No. 2016/171273

SUMMARY OF INVENTION

Technical Problem

Both of the plated steel sheets disclosed in Patent Documents 1 and 2 have an excellent hot lubricity, and enable reduction of the occurrence of processing defects.

In general, when a non-plated material or a plated steel sheet is subjected to hot press forming, wear occurs on sliding surfaces of a die for hot press forming against which the plated steel sheet, such as portions of the plated steel sheet that will become a vertical wall portion and a flange portion of the press-formed product, slides. Therefore, at a portion that experiences a high surface pressure during the hot press forming, maintenance of the die is required in order to deal with the wear that occurs on the sliding surface of the die. Although the plated steel sheets disclosed in Patent Documents 1 and 2 were expected to reduce the die wear, the plated steel sheets of Patent Documents 1 and 2 failed to overcome the problem of the die wear, as with the case of other non-plated materials and plated steel sheets.

Further, the use of the die for plastic working which includes a coating layer on the surface of the die as disclosed in Patent Document 3 also failed to overcome the problem of the wear on the sliding surface of the die, at portions that experience a high surface pressure during the hot press forming.

The present disclosure addresses provision of a method of producing a hot press-formed product, in which the occurrence of wear on a sliding surface of a die is reduced during hot press forming of a hot-dip galvannealed steel sheet including a hot-dip galvannealed layer.

The present disclosure also addresses provision of a die in which the occurrence of wear on the sliding surface is reduced, a die set including the die and a punch, as well as a die set including the die and a steel blank holder.

The present disclosure further addresses provision of a press-formed product which has an excellent surface quality and which reduces the occurrence of delayed fracture.

Solution to Problem

A summary of the present disclosure includes the following.

<1> A method of producing a hot press-formed product, the method including:

placing a hot-dip galvannealed steel sheet, including a hot-dip galvannealed layer, on a die so as to block a die hole of the die, and hot press-forming the hot-dip galvannealed steel sheet using the die, wherein the die includes a hard layer having a skewness (Rsk), as measured in a direction from an outside of the die hole toward an inside of the die hole, of from −5.0 to 1.2, and a hardness Hv_Die of from HV 1,000 to 1,800, over an entirety of a region of a steel sheet contact surface that is adjacent to a die shoulder portion, the steel sheet contact surface being located outside of the die hole and being configured to contact the hot-dip galvannealed steel sheet that is to be subjected to the hot press forming.

<2> The method of producing a hot press-formed product according to <1>, wherein the hard layer includes a nitride layer as an outermost layer.

<3> The method of producing a hot press-formed product according to <1> or <2>, wherein the hard layer includes: a nitride layer; and a hard coating layer provided on a surface of the nitride layer.

<4> The method of producing a hot press-formed product according to any one of <1> to <3>, wherein the hot-dip galvannealed steel sheet includes a zinc compound layer or a metallic zinc layer as an outermost layer on the hot-dip galvannealed layer.

<5> A press-formed product made of a steel sheet, wherein the steel sheet includes: a steel base material having a hardness Hv_Parts of HV 400 or more, a hot-dip galvannealed layer provided on the steel base material, and a zinc oxide layer, as an outermost layer, provided on the hot-dip galvannealed layer, wherein the press-formed product includes: a top wall portion, a vertical wall portion connected to the top wall portion via a first ridge portion, and a flange portion connected to the vertical wall portion via a second ridge portion, wherein a position in the second ridge portion, at which a curvature radius is smallest, has a curvature radius [$R_{min}$] of from 3 mm to less than 10 mm, wherein, in a transverse cross-section of the press-formed product, including a portion PB$\mathbf{0}_{min}$ where the curvature radius of the flange portion when the press-formed product is projected from a direction orthogonal to a longitudinal direction of the press-formed product and parallel to the top wall portion is smallest, a difference [SaB1−SaB2] between a smoothness [SaB1SaB1] at a central portion PB$\mathbf{1}_{min}$, which is a central portion in a width direction of the top wall portion, and a smoothness [SaB2SaB2] at a central portion PB$\mathbf{2}_{min}$, which is a central portion in a height direction of the vertical wall portion, is 0.25 μm or more, and wherein a difference [StrB1−StrB2] between a surface texture aspect ratio [StrB1] at the portion PB$\mathbf{1}_{min}$ in the top wall portion, and a surface texture aspect ratio [StrB2] at the portion PB$\mathbf{2}_{min}$ in the vertical wall portion, is 0.50 or less.

<6> The press-formed product according to <5>, wherein an average thickness of the zinc oxide layer is from 0.3 μm to 2.0 μm.

<7> A die, including a hard layer having a skewness (Rsk), as measured in a direction from an outside of a die hole toward an inside of the die hole, of from −5.0 to 1.2, and a hardness Hv_Die of from HV 1,000 to 1,800, over an entirety of a region of a die shoulder adjacent surface that is adjacent to a die shoulder portion, the die shoulder adjacent surface being located outside of the die hole and adjacent to the die shoulder portion.

<8> The die according to <7>, wherein the hard layer includes a nitride layer as an outermost layer.

<9> The die according to <7> or <8>, wherein the hard layer includes: a nitride layer, and a hard coating layer provided on a surface of the nitride layer.

<10> A die set, including the die according to any one of <7> to <9>, and a punch, wherein the punch includes a second hard layer having a skewness (Rsk), as measured in a direction from an outside of a punch portion toward an inside of the punch portion, of from −5.0 to 1.2, and a hardness Hv_Die of from HV 1,000 to 1,800, over an entirety of a region of a facing surface that faces the region of the die provided with the hard layer, the facing surface facing the die shoulder adjacent surface of the die.

<11> The die set according to <10>, wherein the second hard layer includes a second nitride layer as an outermost layer.

<12> The die set according to <10> or <11>, wherein the second hard layer includes: a second nitride layer, and a second hard coating layer provided on a surface of the second nitride layer.

<13> A die set, including the die according to any one of <7> to <9>, and a steel blank holder, wherein the steel blank holder includes a second hard layer having a skewness (Rsk), as measured in a direction from an outside of a punch-insertion portion toward an inside of the punch-insertion portion, of from −5.0 to 1.2, and a hardness Hv_Die of from HV 1,000 to 1,800, over an entirety of a region of a facing surface that faces the region of the die provided with the hard layer, the facing surface facing the die shoulder adjacent surface of the die.

<14> The die set according to <13>, wherein the second hard layer includes a second nitride layer as an outermost layer.

<15> The die set according to <13> or <14>, wherein the second hard layer includes: a second nitride layer, and a second hard coating layer provided on a surface of the second nitride layer.

Advantageous Effects of Invention

According to the present disclosure, it is possible to provide a method of producing a hot press-formed product, in which the occurrence of wear on a sliding surface of a die is reduced during hot press forming on a hot-dip galvannealed steel sheet including a hot-dip galvannealed layer.

According to the present disclosure, it is also possible to provide a die in which the occurrence of wear on the sliding surface is reduced, a die set including the die and a punch, as well as a die set including the die and a steel blank holder.

Further, according to the present disclosure, it is possible to provide a press-formed product which has an excellent surface quality and which reduces the occurrence of delayed fracture.

DESCRIPTION OF EMBODIMENTS

Figure 1:
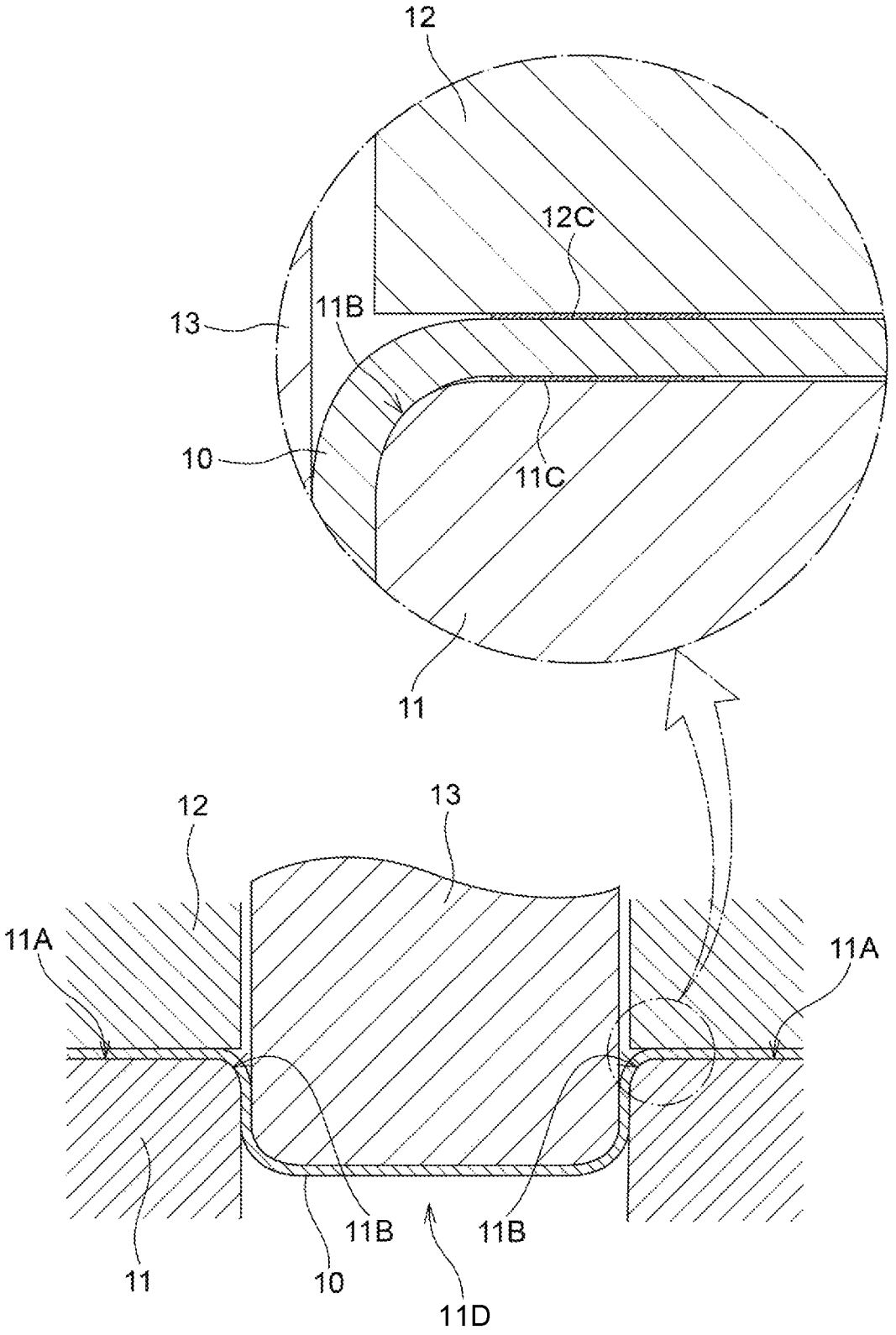
FIG. 1 is a schematic diagram illustrating one example of a plated steel sheet that is being subjected to hot press forming using a die, a holder (steel blank holder), and a punch.

The present disclosure will be described in detail.

Preferable embodiments of the present disclosure will be described in detail below, with reference to accompanying drawings. It is noted, in the present specification and the drawings, there are cases in which components having substantially the same functions and structures are denoted by the same reference characters, and redundant descriptions thereof are omitted.

The "longitudinal direction of a press-formed product" is defined herein as an x-direction. The x-direction is a direction along a line connecting the centers of gravity of respective ends in the longitudinal direction of a top wall portion.

A "direction orthogonal to the longitudinal direction of a press-formed product and parallel to a top wall" is defined as a y-direction. The y direction is a direction along a line connecting first ridges in a transverse cross-section of a press-formed product orthogonal to the longitudinal direction of the press-formed product.

<Method of Producing Hot Press-Formed Product>

A method of producing a hot press-formed product according to one embodiment of the present disclosure will be described.

The method of producing a hot press-formed product according the present embodiment is a method of producing a hot press-formed product, the method including:

placing a hot-dip galvannealed steel sheet, including a hot-dip galvannealed (hereinafter, also simply referred to as "GA plating") layer, on a die so as to block a die hole of the die, and hot press-forming the hot-dip galvannealed steel sheet using the die.

The die includes a hard layer having a skewness (Rsk), as measured in a direction from an outside of a die hole toward an inside of the die hole, of from −5.0 to 1.2, and a hardness Hv_Die of from HV 1,000 to 1,800, over an entirety of a region of a steel sheet contact surface that is adjacent to a die shoulder portion, the steel sheet contact surface being located outside of the die hole and being configured to contact the GA plated steel sheet that is to be subjected to the hot press forming.

When a hot-dip galvannealed steel sheet is placed on a die so as to block a die hole of the die, the hot-dip galvannealed steel sheet may be placed to block the entire die hole or may be placed to block a part of the die hole. For example, in the case of forming a cup-shaped hat material shown in FIG. 5, the hot-dip galvannealed steel sheet is placed so as to block the entire die hole. When forming a groove-shaped hat material shown in FIG. 2, a hot-dip galvannealed steel sheet is placed so as to block a part of a die hole. In other words, ends of the hot-dip galvannealed steel sheet are placed to traverse the die hole.

Due to the above-described configuration, the method of producing a hot press-formed product according to the present embodiment reduces the occurrence of wear on the sliding surface of the die, which otherwise occurs at a high surface pressure portion during the hot press forming. We have found the method of producing a hot press-formed product according to the present embodiment, based on the following findings.

When a conventional GA plated steel sheet (a plated steel sheet having a GA plating layer provided on both surfaces) for hot press forming is subjected to hot press forming, seizure occurs due to reaction of zinc contained in the GA plating layer and the material (iron) contained in a die. There are cases in which the intermetallic compound (zinc adhesion) generated by the seizure attaches to a surface of the die in a large amount.

In order to reduce the adhesion to a die, each of Patent Documents 1 and 2 proposes a plated steel sheet obtained by forming a plating layer on both sides of a steel sheet, and further forming a ZnO film on a surface of each plating layer (hereinafter also referred to as "plated steel sheet with a ZnO film").

In the plated steel sheet with a ZnO film, the surface of each plating layer is covered with a ZnO film. Therefore, the adhesion to the surface of the die due to seizure can be reduced, even when the plated steel sheet with a ZnO film is subjected to hot press forming. As a result, a friction coefficient between the plated steel sheet and the surface of the die is reduced.

However, the die wears even when the ZnO film is present. A region, adjacent to the die shoulder portion, of a surface that is located outside of the die hole and against which a plated steel sheet slides during hot press forming experiences a high surface pressure. Therefore, when a GA plated steel sheet is used, there is a case in which wear occurs on the sliding surface of the die, regardless of the presence or absence of the ZnO film.

In the present embodiment, in contrast, a hard layer is provided over the entirety of a region of a steel sheet contact surface that is adjacent to the die shoulder portion, the steel sheet contact surface being located outside of the die hole of the die and being configured to contact a GA plated steel sheet that is to be subjected to hot press forming. The hard layer has a skewness (Rsk), as measured in a direction from the outside of the die hole toward the inside of the die hole, of from −5.0 to 1.2.

The skewness Rsk as used herein is defined in JIS B 0601 (2001), and is an index that indicates symmetry of protruding portions and recess portions defined relative to a mean line. When the Rsk is positive (0<Rsk), it indicates a state in which the protruding portions and the recess portions localize on the lower side of the mean line. A Rsk that is negative (Rsk<0) indicates a state in which the protruding portions and the recess portions localize on an upper side of the mean line. In other words, when the Rsk is negative (Rsk<0), there are only a few protruding portions that protrude from the surface. A skewness (Rsk) within the above-described range indicates a state where there are only a few protruding portions protruding from the surface of the hard layer, in the direction from the outside of the die hole toward the inside of the die hole. In other words, it means that there are only a few protruding portions protruding from the surface of the hard layer, in the direction in which a GA plated steel sheet slides against the die during hot press forming. Thus, the occurrence of wear is reduced even at a region, adjacent to the die shoulder portion, of the surface against which the plated steel sheet slides, namely, even at a portion that experiences a high surface pressure.

Further, the hard layer described above has a hardness Hv_Die of from HV 1,000 to 1,800. When the hard layer, as an outermost surface layer, has a hardness within the above-described range, the wear of the hard layer itself caused by sliding of the hard GA plated steel sheet is reduced, as a result of which the wear of the die is reduced.

The method of producing a hot press-formed product according to the present embodiment will be described in detail below.

The method of producing a hot press-formed product according to the present embodiment is a method of producing a hot press-formed product in which hot press forming is performed by heating a plated steel sheet, and then stamping the plated steel sheet using a die. In the hot press forming, the plated steel sheet heated to a high temperature is press-formed by the die. Thereafter, the resultant is cooled to obtain a press-formed product having a desired shape.

Hot press forming is performed after a plated steel sheet is placed on a die so as to block a die hole in the die.

—Hot Press Forming—

In the press forming, a steel sheet is formed by being drawn into a die hole of a die. In a case in which an edge portion (die shoulder portion) of the die hole is curved to bulge toward the outside of the die hole, the steel sheet undergoes shrink flange deformation when drawn into the die hole.

In the case of drawing, the thickness at a given position of the steel sheet increases as the portion in the steel sheet comes closer to the edge (die shoulder portion) of the die hole in the case of shrink flange deformation. When the thickness at the position of the steel sheet is increased, a high surface pressure is applied to the position of the steel sheet.

In the case of bending, a given position in the steel sheet wrinkles as the position of the steel sheet comes closer to the edge (die shoulder portion) of the die hole in the case of shrink flange deformation. When wrinkles occur in the steel sheet, the wrinkled portion of the steel sheet near the die hole comes into contact with the die, and the contact portion experiences a high surface pressure.

The same applies to hot press forming. The die according to the present embodiment includes a hard layer at a portion at which a high surface pressure is generated.

Figure 2A:
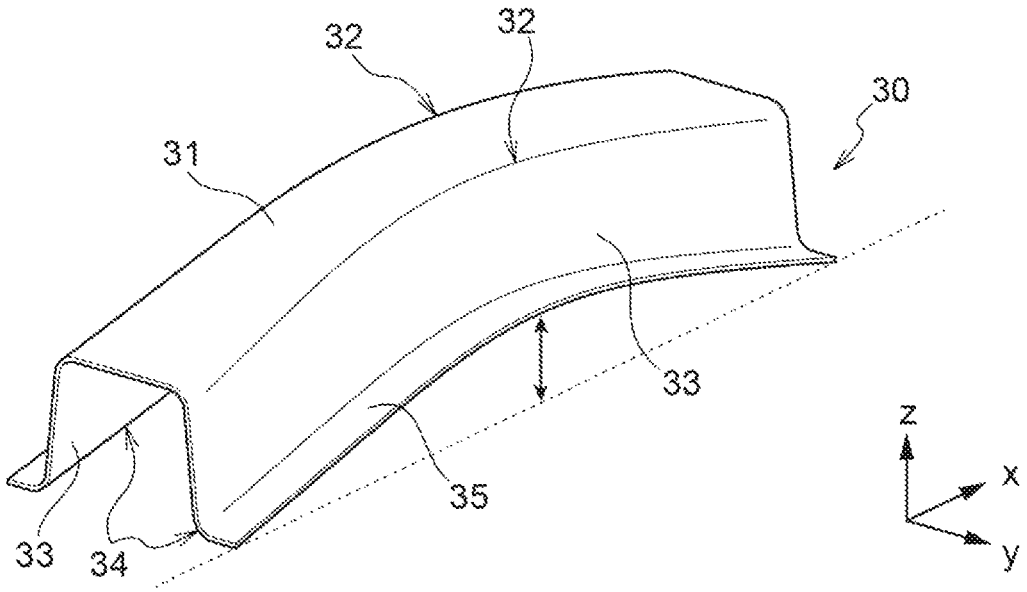
FIG. 2A is a schematic diagram (perspective view) illustrating one example of a press-formed product obtained by the hot press forming shown in FIG. 1.
Figure 2B:
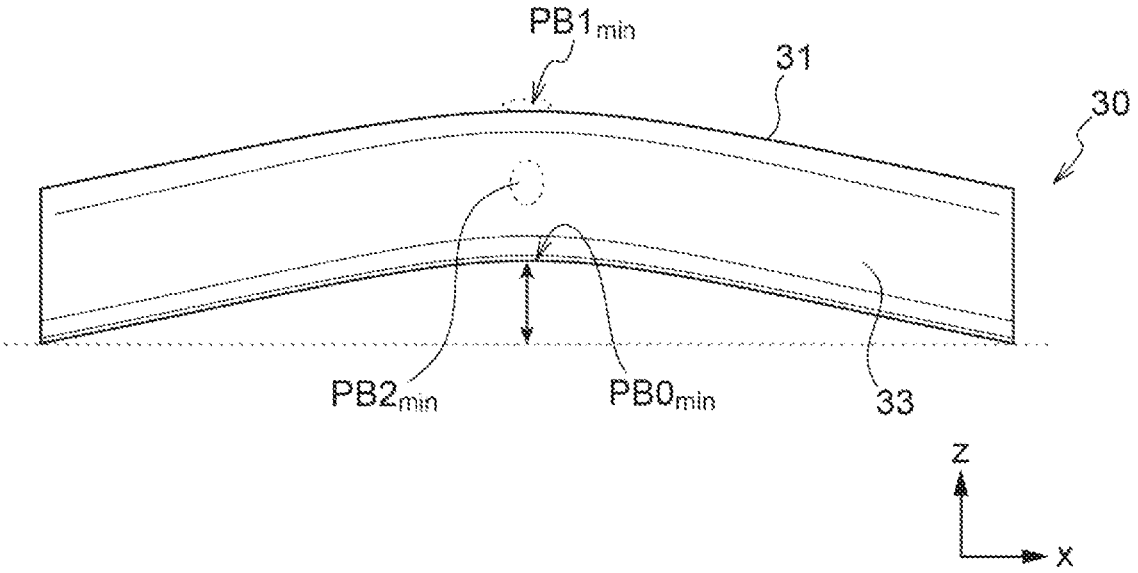
FIG. 2B is a schematic diagram (side view) illustrating one example of a press-formed product obtained by the hot press forming shown in FIG. 1.

FIG. 1 illustrates a plated steel sheet that is being subjected to hot press forming using a die, a holder (steel blank holder), and a punch. Further, FIG. 2A and FIG. 2B illustrate a hot press-formed product formed by the die shown in FIG. 1. It is noted that FIG. 1 is a cross-sectional view corresponding to a cross section in a y-direction, when a hot press-formed product 30 shown in FIG. 2A is formed using the die. In FIG. 2A and FIG. 2B, the longitudinal direction of the hot press-formed product 30 is defined as the x-direction, and, of the directions orthogonal to the x-direction, a direction of viewing from the vertical wall portion 33 side is defined as the y-direction, and a direction which is orthogonal to the x-direction and the y-direction, and which is the viewing direction from the top wall portion 31 side is defined as the z-direction.

The hot press-formed product 30 shown in FIG. 2A and FIG. 2B includes: two vertical wall portions 33; the top wall portion 31 which connects the two vertical wall portions 33 respectively via first ridge portions 32; and flange portions 35 respectively connected to the two vertical wall portions 33 respectively via second ridge portions 34, at a side opposite to the top wall portion 31. When the press-formed product 30 is projected from a direction orthogonal to the longitudinal direction of the press-formed product 30 and parallel to the top wall portion 31 (for example, when observed from the y-direction as shown in FIG. 2B), the hot press-formed product 30 has a shape which includes a portion $PB0_{min}$ at which the curvature radius of the flange portion 35 is smallest. In other words, the flange portion 35 includes a portion in the length in the longitudinal direction (the x-direction) at which the flange portion 35 is curved, and the flange portion 35, as a whole, does not have a constant curvature radius. Further, the top wall portion 31 also includes a portion in the length in the longitudinal direction (the x-direction) at which the top wall portion 31 is curved, as with the flange portions 35.

Figure 3A:
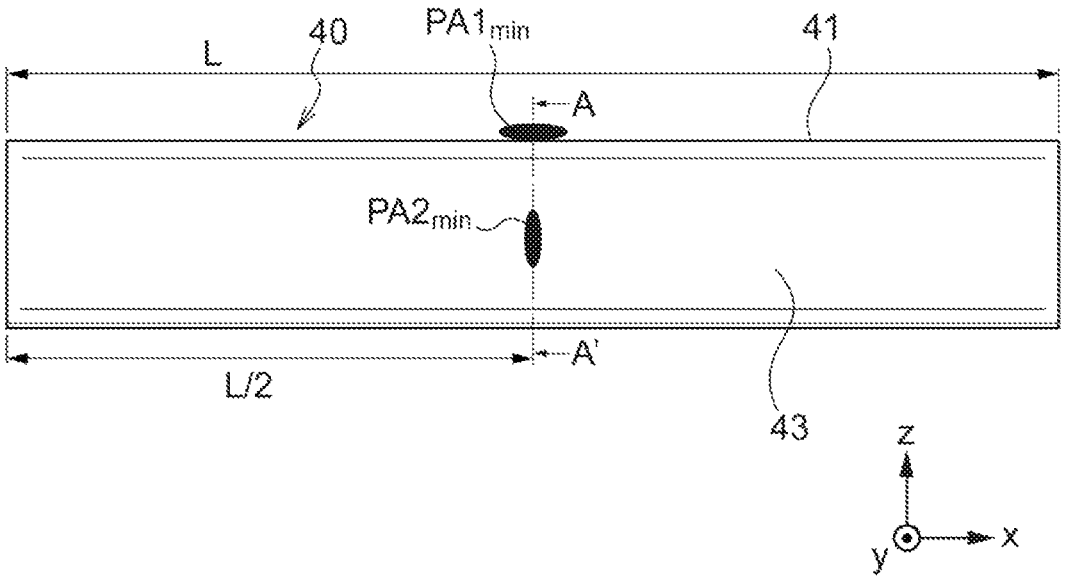
FIG. 3A is a schematic diagram illustrating another example of a press-formed product obtained by the hot press forming according to the present embodiment.
Figure 3B:
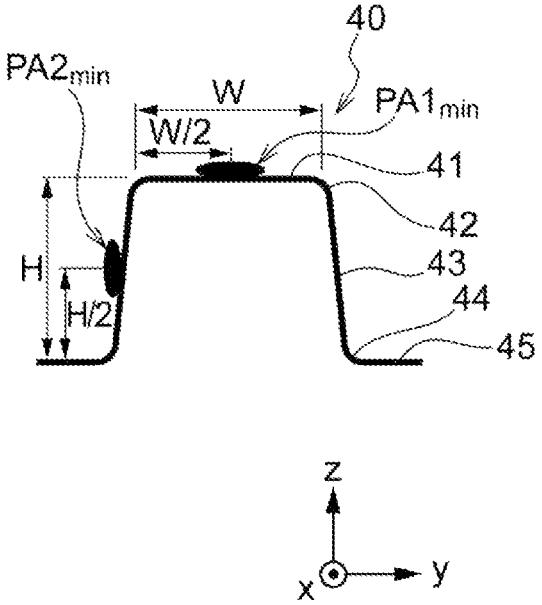
FIG. 3B is a cross-sectional view along the line A-A' in FIG. 3A.

The hot press-formed product to be formed by the die according to the present embodiment is not limited to a product having the shape shown in FIG. 2A or FIG. 2B. For example, the hot press-formed product may be a formed product in which the top wall portion and flange portions have flat shapes, as shown in FIG. 3A and FIG. 3B. FIG. 3B is a cross-sectional view along the line A-A' in FIG. 3A.

In FIG. 3A and FIG. 3B, the longitudinal direction of a hot press-formed product 40 is defined as the x-direction, and, of directions orthogonal to the x-direction, a direction of viewing from the vertical wall portion 43 side is defined as the y-direction, and a direction which is orthogonal to the x-direction and the y-direction, and which is the viewing direction from the top wall portion 41 side is defined as the z-direction.

The hot press-formed product 40 shown in FIG. 3A and FIG. 3B includes: two vertical wall portions 43; the top wall portion 41 which connects the two vertical wall portions 43 via first ridge portions 42; and flange portions 45 respectively connected to the two vertical wall portions 43 respectively via second ridge portions 44, at a side opposite to the top wall portion 41. When observed in a cross section (a transverse cross section, such as the cross section shown in FIG. 3B) in a direction orthogonal to the longitudinal direction (the x-direction), the hot press-formed product 40 has a shape in which each second ridge portion 44 has the same curvature radius value in any transverse cross section regardless of the position to be sectioned. Further, the hot press-formed product 40 has a shape with left-right symmetry in any transverse cross section regardless of the position to be sectioned.

Further, the hot press-formed product to be formed using the die according to the present embodiment is not limited to a product having a shape with left-right symmetry in a transverse cross section, such as that shown in FIG. 3A and FIG. 3B. For example, the hot press-formed product may be a formed product of which the shape of the left part and the shape of the right part in a transverse cross section are asymmetrical, such as that of a center pillar shown in FIG. 4A and FIG. 4B. FIG. 4B is a cross-sectional view along the line B-B' in FIG. 4A.

Figure 4A:
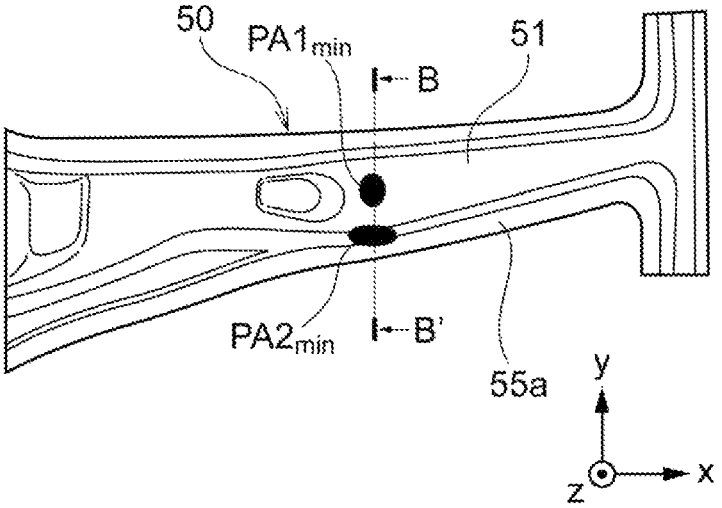
FIG. 4A is a schematic diagram illustrating another example of a press-formed product obtained by the hot press forming according to the present embodiment.
Figure 4B:
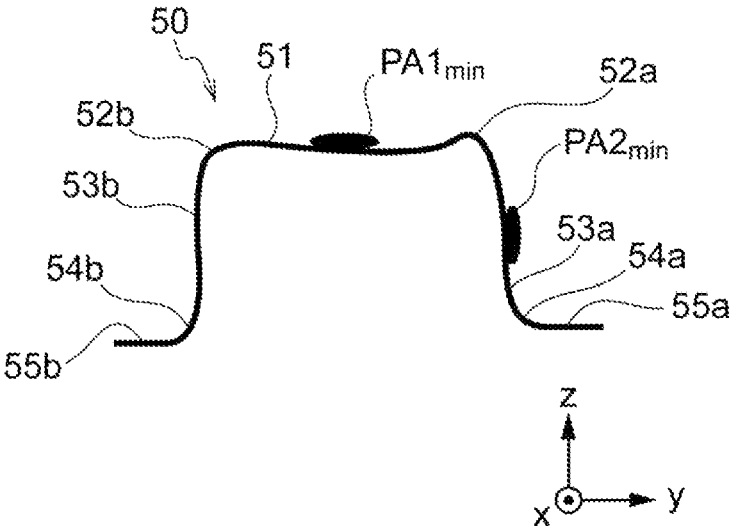
FIG. 4B is a cross-sectional view along the line B-B' in FIG. 4A.

In FIG. 4A and FIG. 4B, the longitudinal direction of a hot press-formed product 50 is defined as the x-direction, and, of directions orthogonal to the x-direction, a direction of viewing from the vertical wall portion 53*a* side is defined as the y-direction, and a direction which is orthogonal to the x-direction and the y-direction, and which is the viewing direction from the top wall portion 51 side is defined as the z-direction.

The hot press-formed product 50 shown in FIG. 4A and FIG. 4B includes: two vertical wall portions 53*a* and 53*b*; the top wall portion 51 which connects the two vertical wall portions 53*a* and 53*b* via first ridge portions 52*a* and 52*b*, respectively; and flange portions 55*a* and 55*b* respectively connected to the two vertical wall portions 53*a* and 53*b* via second ridge portions 54*a* and 54*b*, respectively, at a side opposite to the top wall portion 51. When a cross section (transverse cross section) orthogonal to the longitudinal direction (the x-direction) of the hot press-formed product 50 is observed, there are portions of which shapes do not have left-right symmetry. For example, in the transverse cross section shown in FIG. 4B, the heights in the z-direction of the two first ridge portions 52*a* and 52*b* present on both side of the flat top wall portion 51 are different, and the first ridge portion 52*a* on the right side protrudes higher in the z-direction than the first ridge portion 52*b* on the left side. Further, in the transverse cross section shown in FIG. 4B, the heights in the z-direction of the two flange portions 55*a* and 55*b* are also different, and the flange portion 55*a* on the right side is higher than the flange portion 55*b* on the left side. When observed in a transverse cross section, the hot press-formed product 50 has a shape in which the curvature radii of the second ridge portions 54*a* and 54*b* vary with the positions to be sectioned, and in which the curvature radius of the second ridge portion 54*a* in the transverse cross section shown in FIG. 4B is smallest.

In the forming of any of these hot press-formed products (for example, the hot press-formed product 30), as shown in FIG. 1, when a punch 13 is pressed against a plated steel sheet 10 to be inserted into a die hole 11D in hot press forming, the plated steel sheet 10 is pressed to the inside of the die hole 11D. At this time, as a given position in the plated steel sheet 10 comes closer to the die hole 11D, the steel sheet at the position undergoes a shrink flange deformation, as a result of which the sheet thickness of the hot press-formed product 20 increases. In FIG. 1, a die 11 includes a hard layer 11C over the entirety of a region, adjacent to a die shoulder portion 11B, of a steel sheet contact surface 11A which is a surface that is located outside of the die hole 11D and that is configured to contact the plated steel sheet 10 that is to be subjected to the hot press forming.

When the hard layer 11C satisfies the above-described limitations concerning skewness (Rsk) and hardness Hv_Die, it is possible to reduce the occurrence of wear on the sliding surface of the die 11, which occurs at a high surface pressure portion during hot press forming of a GA plated steel sheet.

Further, a holder (steel blank holder) 12 preferably includes a second hard layer 12C over the entirety of a region of a facing surface that faces the portion of the die 11 provided with the hard layer 11C, the facing surface facing the steel sheet contact surface 11A of the die 11.

When the second hard layer 12C satisfies the above-described skewness (Rsk) and hardness Hv_Die, it is possible to reduce the occurrence of wear on the sliding surface of the holder 12, which occurs at a high surface pressure portion during the hot press forming of the GA plated steel sheet.

Further, from the viewpoint of reducing the wear of the die 11, the hard layer 11C is preferably formed over the entirety of a region along the die shoulder portion 11B. However, in a case in which the region to be provided with the hard layer 11C is restricted from the viewpoint of cost and the like, the hard layer 11C may be formed at a portion that experiences a particularly high surface pressure.

From the viewpoint of reducing the wear of the holder 12, the second hard layer 12C is preferably formed over the entirety of a region along the portion facing the die shoulder portion 11B of the die 11. However, in a case in which a region to be provided with the second hard layer 12C is restricted from the viewpoint of cost and the like, the second hard layer 12C may be formed at a portion that experiences a particularly high surface pressure.

It is noted, in the present embodiment, that the shape of the hot press-formed product to be formed is not limited to the shapes shown in FIG. 2A and FIG. 2B, FIG. 3A and FIG. 3B, FIG. 4A and FIG. 4B, and the like. Press-formed products having a variety of other shapes, such as a press-formed product having a hat shape illustrated in FIG. 5, can be produced.

The occurrence of wear at a high surface pressure portion on the sliding surface of the die can be reduced by using, as a die to be used for the press forming, a die including a hard layer over the entirety of a region of the steel sheet contact surface that is adjacent to the die shoulder portion, the steel sheet contact surface being located outside of the die hole and being configured to contact a GA plated steel sheet that is to be subjected to the hot press forming, and the hard layer having a skewness (Rsk) as measured in a direction from the outside of the die hole toward the inside of the die hole within the above-specified range and a hardness Hv_Die within the above-specified range.

In the method of producing a hot press-formed product according to the present embodiment, hot press forming includes softening a plated steel sheet by heating the plated steel sheet to a high temperature, for example, after performing blanking (punching) if necessary. Thereafter, the softened plated steel sheet is formed by being stamped using the die, and then cooled. In the hot press forming, temporarily softening the plated steel sheet makes easier the subsequent stamping. Further, the press-formed product obtained by the hot press forming is quenched by heating and cooling, thereby becoming a formed product having a high tensile strength of about 1,500 MPa or more.

As the heating method for performing the hot press forming, it is possible to use a heating method using an ordinary electric furnace or a radiant tube furnace, or alternatively, a heating method employing an infrared heating, electric heating, induction heating or the like. The heating is performed under an oxidizing atmosphere.

—Die—

Next, the die according to the present embodiment will be described in detail.

The die of the present embodiment is not particularly limited in its application, and can be used, for example, as a die for performing hot press forming on a GA plated steel sheet including a GA plating layer, or GA plated steel sheet further including a zinc compound layer or a metallic zinc layer as an outermost layer on top of the GA plating layer.

The die includes a hard layer having a skewness (Rsk), as measured in a direction from the outside of the die hole toward the inside of the die hole, of from −5.0 to 1.2, and a hardness Hv_Die of from HV 1,000 to 1,800, the hard layer being provided over the entirety of a region of a die shoulder adjacent surface that is adjacent to a die shoulder portion, the die shoulder adjacent surface being a surface that is located outside of the die hole and that is adjacent to the die shoulder portion.

When the die is used in the method of producing a hot press-formed product according to the present embodiment, the hard layer having a skewness (Rsk), as measured in a direction from the outside of the die hole toward the inside of the die hole, of from −5.0 to 1.2 and a hardness Hv_Die of from HV 1,000 to 1,800 is provided over the entirety of a region of the steel sheet contact surface that is adjacent to the die shoulder portion, the steel sheet contact surface being a surface that is located outside of the die hole and that is configured to contact a GA plated steel sheet that is to be subjected to the hot press forming.

Skewness Rsk

When the hard layer included in the die has a skewness (Rsk), as measured in a direction from the outside of the die hole toward the inside of the die hole, of 1.2 or less, it is possible to reduce the occurrence of wear at a high surface pressure portion on the sliding surface of the die during the hot press forming. When a GA plated steel sheet is hot press-formed, zinc adhesion may be generated and adhere to the surface of the die, but adhesion to the die is reduced by regulating the upper limit of the skewness (Rsk) within the above range. As a result, the friction coefficient between the die and the surface of the plated steel sheet is reduced.

The skewness (Rsk) of the hard layer is more preferably 1.0 or less, and still more preferably 0.8 or less.

Further, the lower limit value of the skewness (Rsk) of the hard layer is −5.0 or more, and more preferably −3.0 or more, from the viewpoint of curbing an increase in the production cost caused by performing surface control for reducing the skewness (Rsk).

The skewness Rsk as used herein is measured in accordance with JIS B 0601 (2001). Specifically, the skewness Rsk is measured in accordance with JIS B 0601 (2001) under the following measurement conditions.

(Measurement Conditions)

Measuring apparatus: a surface roughness/contour measuring apparatus "FORMTRACER", manufactured by Mitutoyo Corporation Measuring length L: 9.6 mm Cut-off wavelength λc: 0.8 mm Stylus tip shape: a cone with a tip angle of 60°

Stylus tip radius: 2 μm

Measuring speed: 1 mm/sec

The method used for controlling the skewness (Rsk), as measured in a direction from the outside of the die hole toward the inside of the die hole, of the hard layer to the above-described range is not particularly limited. For example, a method including polishing the surface of the hard layer formed can be used, in which the polishing is performed in a direction from the outside of the die hole toward the inside of the die hole (namely, in the direction in which the plated steel sheet slides during the hot press forming). For example, in a case in which the polishing is performed by sliding a polishing sheet, the polishing may be performed by sliding the polishing sheet in the direction from the outside of the die hole toward the inside of the die hole.

Hardness Hv_Die

When the hard layer included in the die has a hardness Hv_Die of HV 1,000 or more, it is possible to reduce the occurrence of wear at a high surface pressure portion on the sliding surface of the die during hot press forming.

The hardness Hv_Die of the hard layer is more preferably HV 1,200 or more.

The upper limit of the hardness Hv_Die of the hard layer is HV 1,800 or less. When the upper limit is HV 1,800 or less, it is possible to reduce the scraping of a GA plating layer in a GA plated steel sheet, or, in the case of further including a zinc compound layer or a metallic zinc layer, it is possible to reduce the scraping of the zinc compound layer or the metallic zinc layer. When a GA plated steel sheet is hot-press formed, a zinc adhesion may be generated and adhere to the surface of a die, but when the upper limit of the hardness Hv_Die is within the above range, adhesion to the die is reduced. As a result, the friction coefficient between the die and the surface of the plated steel sheet is reduced.

The upper limit of the hardness Hv_Die of the hard layer is more preferably HV 1,600 or less.

The hardness Hv_Die as used herein refers to "Vickers hardness" as defined in JIS-Z-2244 (2009), and, in the present specification, refers to a hardness value as measured in accordance with the Vickers hardness test method at a test load of 0.2452 N.

As a micro Vickers tester, HM-115 manufactured by Mitutoyo Corporation is used.

Formation of Hard Layer

In the present embodiment, the material of the hard layer provided on the die and the method used for forming the hard layer are not limited, as long as the hard layer satisfies the above-described limitations concerning the skewness Rsk and the hardness Hv_Die.

Examples of the hard layer include a layer including a nitride layer as an outermost layer. Examples of the hard layer also include a layer having a hard coating layer (more preferably a layered hard layer that includes a nitride layer and a hard coating layer on the surface of the nitride layer).

A nitride layer is preferably formed by a method involving surface hardening treatment utilizing diffusion such as nitriding. The formation of the nitride layer is performed by subjecting the base material of the die, for example, to an ion nitriding treatment, more specifically, an ion nitriding treatment in a gas atmosphere of $N_2$ and $H_2$ with predetermined concentrations at a controlled temperature.

In this process, a compound layer such as a nitride layer referred to as a "white layer" that may be generated in the nitriding treatment lowers the adhesion property. Therefore, it is desirable to avoid the formation of the compound layer by controlling treatment conditions, or to remove the compound layer, for example, by polishing.

Examples of the hard coating layer include a vapor-deposition film formed by physical vapor deposition (PVD). The type of the physical vapor deposition method is not particularly limited. Alternatively, a chemical vapor deposition (CVD) method may be used. As the physical vapor deposition method, for example, an arc ion plating method or a sputtering method is desirable.

In particular, the vapor-deposition film as the hard coating layer is preferably a film including at least one of Ti or Cr. For example, the film is preferably formed from any one of a nitride, a carbide or a carbonitride, of which the metal element portion is mainly composed of one or more elements selected from Ti, Cr or Al. Further, the film is more preferably any of a nitride, a carbide or a carbonitride, of which the metal element portion is mainly composed of Ti or Cr.

With respect to "mainly composed of", it is preferable that Ti, Cr or Al (or alternatively, Ti or Cr) accounts for 70 (atomic %) or more, more preferably 90 (atomic %) or more (including substantially 100 (atomic %)), in metal components (including semimetals) from which nitrogen and carbon have been excluded.

The vapor-deposition film as the hard coating layer can be obtained by, for example, forming a PVD film on a surface of a base material of the die by using a reaction gas (such as $N_2$ gas or $CH_4$ gas) and any of various types of metallic targets as an evaporation source of a metal component or metal components, with application of a bias voltage at a regulated temperature and a regulated gas pressure.

Specific examples thereof include a nitride film, carbide film, or carbonitride film that includes one or more elements selected from the group consisting of Ti, Cr and Al as main components, and a diamond-like carbon (DLC) film.

A layered hard layer that includes a nitride layer and a hard coating layer on the surface of the nitride layer can be obtained, for example, by forming a nitride layer by the above-described method and then further forming a hard coating layer (for example, a vapor-deposition film) by the above-described method or the like.

Base Material

The metallic material of the base material of the die is not particularly limited, and it is possible to use a known metallic material, such as a cold working die steel, a hot working die steel, a high-speed steel, or a cemented carbide. As for the metallic material, it is also possible to use any of improved metal grades which have been proposed as steel grades which can be used in conventional dies, including standard metal grades (steel grades) defined, for example, in JIS.

—Die Set—

Next, a die set according to the present embodiment will be described in detail.

The die set as used herein may refer to a combination of: a die; and a punch having a protruding portion corresponding to a die hole of the die, and a facing surface that faces the steel sheet contact surface (die shoulder adjacent surface) of the die. Further, the die set may alternatively refer to a combination of: a die; and a steel blank holder (holder) having a facing surface that faces the steel sheet contact surface (die shoulder adjacent surface) of the die, and a hole through which a punch to be inserted into a die hole passes.

A first die set according to the present embodiment includes the above-described die according to the present embodiment, and a punch.

The punch includes a second hard layer having a skewness (Rsk), as measured in a direction from the outside of a punch portion toward the inside of the punch portion, of from −5.0 to 1.2, and a hardness Hv_Die of from HV 1,000 to 1,800, the second hard layer being provided over the entirety of a region of the facing surface that faces a portion of the die provided with the hard layer, the facing surface facing the die shoulder adjacent surface (steel sheet contact surface) of the die.

Figure 6:
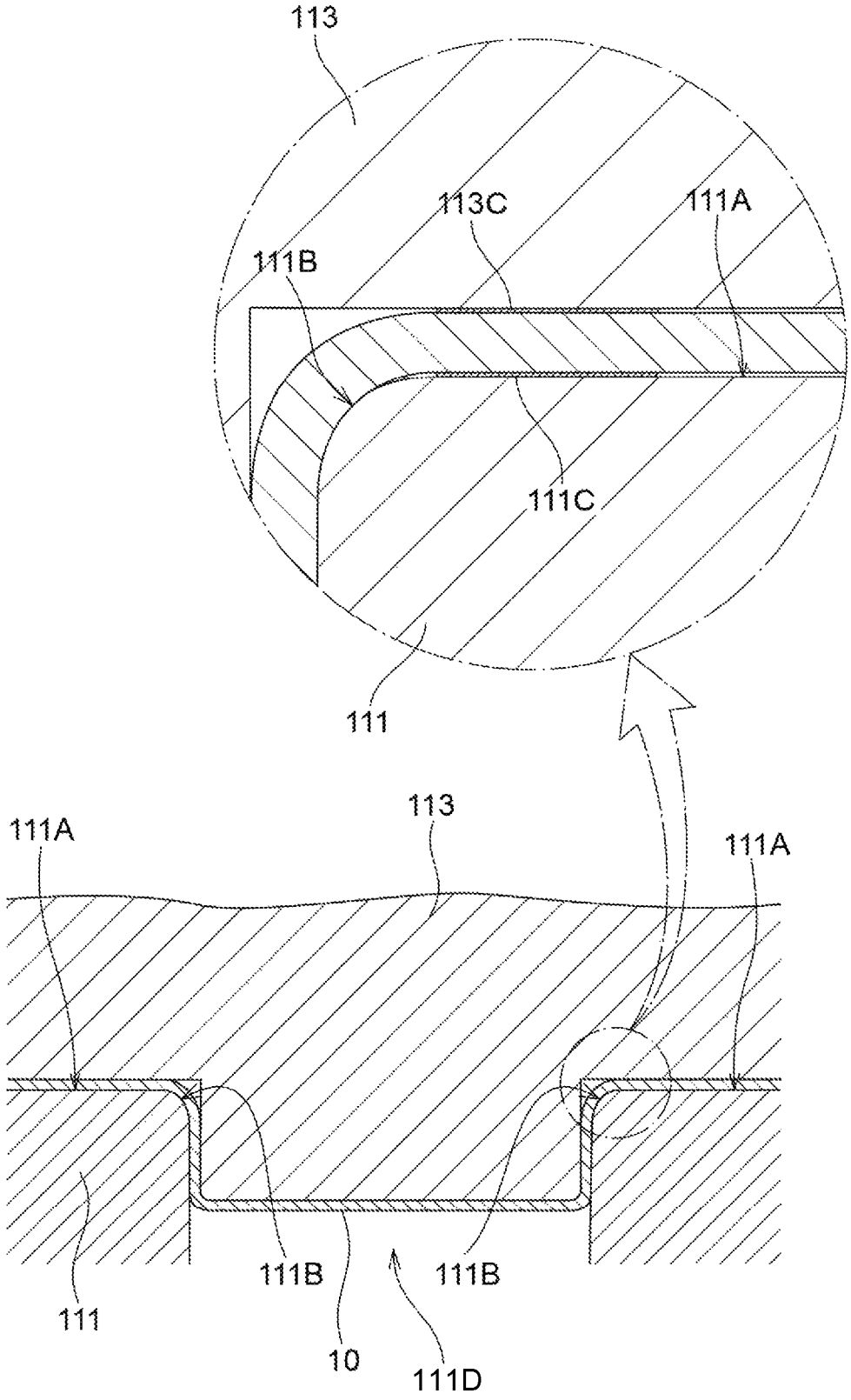
FIG. 6 is a schematic diagram illustrating one example of a plated steel sheet that is being subjected to hot press forming using a die and a punch.
Figure 7:
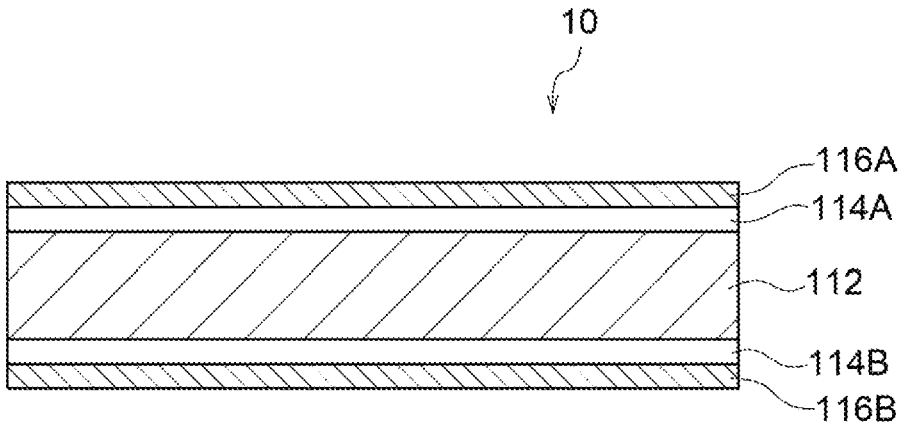
FIG. 7 is a schematic cross-sectional view illustrating one example of a hot-dip galvannealed steel sheet used in the present embodiment.

For example, a die 111 shown in FIG. 6 includes a hard layer 111C over the entirety of a region, adjacent to a die shoulder portion 111B, of a steel sheet contact surface 111A, the steel sheet contact surface 111A being a surface that is located outside a die hole 111D and that is configured to contact the plated steel sheet 10 that is to be subjected to hot press forming. Further, a punch 113 preferably includes a second hard layer 113C over the entirety of a region of the facing surface that faces the portion of the die 111 provided with the hard layer 111C, the facing surface facing the steel sheet contact surface 111A of the die 111. This is because a wrinkled portion of the plated steel sheet 10 comes into contact with the portion provided with the second hard layer 113C when the punch 113 has moved to a position close to the bottom dead center in the forming.

A second die set according to the present embodiment includes: the above-described die according to the present embodiment; and a steel blank holder.

The steel blank holder includes a second hard layer having a skewness (Rsk), as measured in a direction from the outside of a punch-insertion portion toward the inside of the punch-insertion portion, of from −5.0 to 1.2, and a hardness Hv_Die of from HV 1,000 to 1,800, over the entirety of a region of a facing surface that faces the portion of the die provided with the hard layer, the facing surface facing the die shoulder adjacent surface (steel sheet contact surface) of the die.

As described above, the holder (steel blank holder) 12 shown, for example, in FIG. 1 preferably includes the second hard layer 12C over the entirety of a region of a facing surface that faces the portion of the die 11 provided with the hard layer 11C, the facing surface facing the steel sheet contact surface 11A of the die 11.

The above-described preferable embodiments described for the hard layer included in the die according to the present embodiment apply as-is as preferable embodiments of the second hard layer in the punch included in the first die set according to the present embodiment, and preferable embodiments of the second hard layer in the steel blank holder included in the second die set according to the present embodiment.

Next, the GA plated steel sheet used in the method of producing a hot press-formed product according to the present embodiment will be described in detail.

(Plated Steel Sheet)

A GA plated steel sheet includes a GA plating layer on a steel base material. A zinc compound layer or a metallic zinc layer may be further provided as an outermost layer on the GA plating layer.

Figure 5:
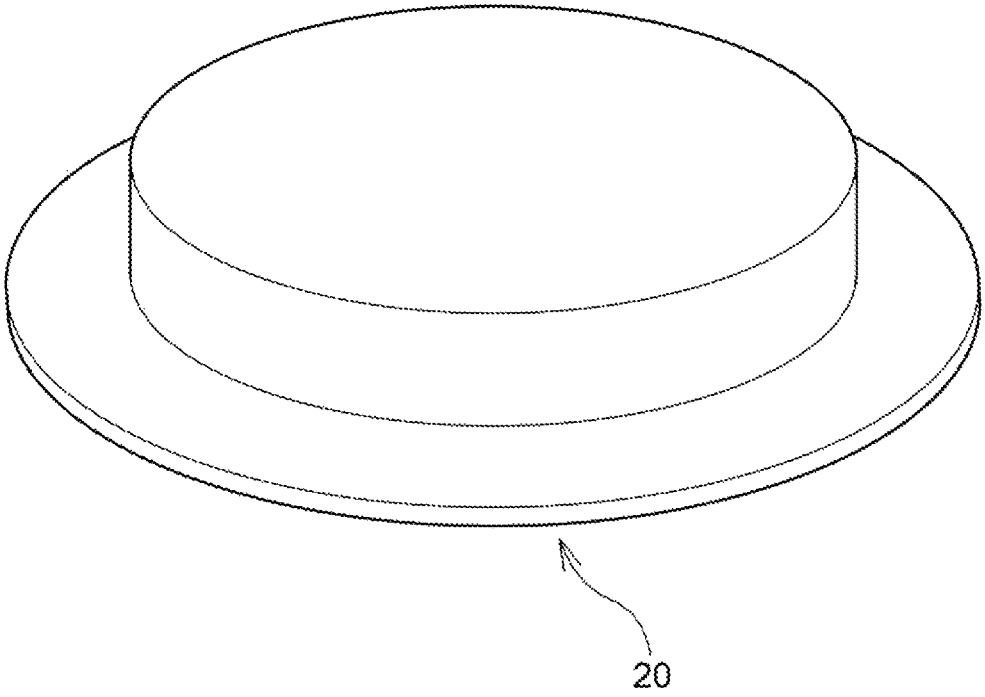
FIG. 5 is a schematic diagram illustrating another example of a press-formed product obtained by the hot press forming according to the present embodiment.

As in the plated steel sheet 10 shown in FIG. 5, the plated steel sheet includes, for example: GA plating (hot-dip galvannealed) layers 114A and 114B provided on respective surfaces (upper surface and lower surface) of a steel sheet (steel base material) 112; and zinc compound layers or metallic zinc layers 116A and 116B, as outermost surface layers, provided on the GA plating layers 114A and 114B, respectively.

Steel Base Material

A steel sheet to be plated (a steel sheet before plating, steel base material) is preferably a steel sheet having, for example, a high mechanical strength (the mechanical strength refers to various properties related to mechanical deformation and fracture, such as tensile strength, yield point, elongation, drawing, hardness, impact value, fatigue strength, and creep strength). An example of the steel sheet (steel sheet before plating) achieving a high mechanical strength and used in the plated steel sheet according to the present embodiment is described below.

It is noted that "%" refers to "% by mass", unless otherwise specified. Further, in the present specification, any numerical range described using "to" refers to a range in which numerical values described before and after the "to" are included as the lower limit value and the upper limit value of the range.

The steel sheet preferably includes, in % by mass, at least one or more of from 0.01 to 0.6% of C, from 0.01 to 0.6% of Si, from 0.5 to 3% of Mn, from 0.01 to 0.1% of Ti, or from 0.0001 to 0.1% of B, and a balance consisting of Fe and impurities.

C is included for the purpose of ensuring a desired mechanical strength. When the C content is less than 0.01%, a sufficient improvement in the mechanical strength cannot be obtained, and the effect of including C is reduced. When the C content is more than 0.6%, the steel sheet can be further hardened, but becomes more susceptible to melt cracking. Accordingly, the C content is preferably from 0.01% to 0.6%.

Si is one of strength-improving elements which improve the mechanical strength, and is included for the purpose of ensuring a desired mechanical strength, as with the case of C. When the Si content is less than 0.01%, the effect with respect to improvement in strength is scarcely exerted, and a sufficient improvement in the mechanical strength is not obtained. Si is also an oxidizable element. Therefore, a Si content of more than 0.6% may result in a decreased wettability during GA plating, which may cause a plating failure. Accordingly, the Si content is preferably from 0.01% to 0.6%.

Mn is one of strengthening elements which strengthen the steel, and also one of the elements which enhance hardenability. Further, Mn is also effective for preventing hot brittleness caused by S, which is one of the impurities. When the Mn content is less than 0.5%, the above-described effects are not obtained. When the Mn content is 0.5% or more, these effects are obtained. However, when the Mn content is more than 3%, the amount of residual γ-phase may excessively increase, which may result in a decrease in the strength. Accordingly, the Mn content is preferably from 0.5% to 3%.

Ti is one of the strengthening elements, and also improves the heat resistance of the GA plating layer. When the Ti content is less than 0.01%, the effects in terms of improving the strength and oxidation resistance are not obtained. When the Ti content is 0.01% or more, these effects are obtained. However, the inclusion of an excessive amount of Ti may result, for example, in formation of carbides or nitrides, which may soften the steel. When the Ti content is more than 0.1%, in particular, a desired mechanical strength is unlikely to be obtained. Accordingly, the Ti content is preferably from 0.01% to 0.1%.

B has the effect in terms of improving the strength by acting during quenching. When the B content is less than 0.0001%, the effect in terms of improving the strength is low. When the B content is more than 0.1%, inclusions may be formed and cause embrittlement, which may decrease the fatigue strength. Accordingly, the B content is preferably from 0.0001% to 0.1% or less.

The steel sheet may include impurities which are inevitably incorporated, for example, during production processes.

The steel sheet formed of the above-described chemical components can be made to have a mechanical strength of about 1,500 MPa or more, by being quenched from heating during the hot press forming or the like. Even though the steel sheet has a high mechanical strength as described above, the steel sheet can be easily formed by hot press forming; this is because the steel sheet can be hot stamped in a softened state achieved by heating. The steel sheet is capable of realizing a high mechanical strength, and, in addition, capable of maintaining or improving the mechanical strength even with a thickness reduced for the purpose of weight reduction.

GA Plating Layer

A GA plating (hot-dip galvannealed) layer will be described.

A GA plating layer is formed by forming a hot-dip galvanizing layer on a steel sheet (steel base material), and then performing alloying treatment, and examples thereof include a method of forming a GA plating layer including performing plating treatment using a reduction furnace. In general, in plating treatment using a reduction furnace, a pretreatment process, an annealing process, a plating process, and an alloying treatment process are performed. As a matter of course, the method is not limited to the above-described example in the present embodiment, and, for example, a plating treatment may alternatively be performed using a non-oxidation furnace. In the following, explanations are presented assuming that the method using a reduction furnace is used.

First, a steel sheet (steel base material) is pretreated. The pretreatment is usually performed to remove oil (grease) or dirt from the surface of a steel sheet, and is typically performed by alkaline degreasing. In the present embodiment, however, there is no limitation on the pretreatment method as long as the surface of the steel sheet is degreased appropriately. When alkaline degreasing has been performed as a pretreatment, then the steel sheet is hot rinsed (hot water washing) and dried with a dryer, for example, in order to remove a degreasing liquid adhered thereto.

Next, the above pretreated steel sheet is put into a reduction furnace, and annealed (heat treatment under a reducing atmosphere) in the reduction furnace. The annealing conditions at this time are, for example, in the range of from 500 to 700° C. (annealing temperature and soaking temperature) and the residence time (annealing time and soaking time) is from 30 to 270 seconds. The annealing treatment in the above temperature range is also referred to as soaking treatment. The atmosphere and dew point during reduction are not particularly limited. For example, in the case of an $H_2$—$N_2$ mixture gas, the concentration of $H_2$ may be from 1 to 30%, and the dew point may be in the range of from −10 to −60° C. The steel sheet discharged from the reduction furnace is cooled in a cooling zone. Examples of the cooling method include a normally used method such as blowing a reducing atmosphere gas onto a steel sheet.

After the annealing process is thus performed, galvanizing is performed. Specifically, a hot-dip galvanizing layer is formed by hot-dip galvanizing, followed by forming GA plating (hot-dip galvannealed) layer by an alloying treatment process.

The plating (hot-dip galvanizing) process is not particularly limited, and a normally used method can be employed. For example, the temperature of a hot-dip galvanizing bath may be controlled at about from 430 to 500° C.

The alloying treatment process is not particularly limited, and a normally used method can be employed. For example, the alloying temperature may be regulated to be from about 500 to about 700° C.

After a GA plating layer is thus formed, a skin-pass treatment, a tension leveler treatment, an oil applying treatment, or the like may be performed.

After the above-described alloying treatment, re-annealing may be performed. In the conditions for re-annealing, the heating temperature (re-annealing temperature) is preferably 400° C. or more. Nevertheless, the re-annealing temperature is preferably 750° C. or less from the viewpoint of reducing evaporation of zinc. The length of time (re-annealing time) for which the steel sheet is retained at the above-described re-annealing temperature may be set appropriately in accordance with, for example, the heating method. For example, in the case of furnace heating, the re-annealing time is preferably one hour or more (more preferably two hours or more), and in the case of induction heating, the re-annealing time is preferably 10 seconds or more. On the other hand, from the viewpoint of reducing evaporation of zinc, the re-annealing time in the case of the above-described furnace heating is preferably 15 hours or less, and more preferably 10 hours or less. In the case of the above-described induction heating, the re-annealing time is preferably 3 minutes or less, and more preferably 1 minute or less.

In regard to the component composition of the GA plating layer, the GA plating layer is, for example, a zinc-based alloy plating layer formed from zinc and another metal (for example, at least one selected from the group consisting of iron, aluminum, cobalt, tin, nickel, chromium, titanium, magnesium, and manganese). The component composition of the GA plating layer may further include, in addition to the above zinc-based alloy, small amounts of other metal elements or impurities (such as cobalt, molybdenum, tungsten, nickel, titanium, chromium, aluminum, manganese, iron, magnesium, lead, bismuth, antimony, tin, copper, cadmium, or arsenic). The GA plating layer may further include an inorganic material such as silica, alumina, or titania.

The component composition of the GA plating layer preferably includes from 5 to 20% of Fe, from 0.01 to 0.20% by mass of Al, and the balance consisting of Zn and impurities.

The deposited amount (areal weight) of the GA plating layer is preferably from 20 to 100 g/m$^2$ in terms of Zn amount. When the deposited amount of the GA plating layer is adjusted to 20 g/m$^2$ or more, a suitable amount of zinc adhesion adheres to the sliding surface of the die, and the effect in terms of reducing the wear on the sliding surface of the die is enhanced. Further, the corrosion resistance of the press-formed product also improves. When the deposited amount of the GA plating layer is adjusted to more than 100 g/m$^2$, a large amount of zinc adhesion adheres to the sliding surface of the die, and increases the tendency toward occurrence of wear on the sliding surface of the die.

The deposited amount of the GA plating layer is evaluated by the deposited amount in terms of Zn amount. The deposited amount of the GA plating layer is measured using an X-ray fluorescence method. Specifically, a calibration curve is prepared using several kinds of standard samples each having a GA plating layer in a known deposited amount (in terms of Zn amount), using the X-ray fluorescence method. Thereafter, the Zn intensity of a sample to be measured is converted to the deposited amount of the GA plating layer, based on the calibration curve, to determine the deposited amount of the GA plating layer.

Zinc Compound Layer or Metallic Zinc Layer

A zinc compound layer (Zn compound layer) or a metallic zinc layer (metallic Zn layer) is a ZnO film, or is a layer which becomes a ZnO film during hot press forming. Before being subjected to hot press forming, the plated steel sheet is heated in an oxidizing atmosphere. At this time, a metallic Zn layer or a Zn compound layer other than a ZnO film is oxidized to form a ZnO film. The type of the Zn compound layer other than a ZnO film or of the metallic Zn layer is not particularly limited, as long as the layer forms a ZnO film when oxidized. Examples of the Zn compound layer other than a ZnO film include a zinc phosphate layer and a Zn-based metallic soap layer. Further, a Zn compound or metallic Zn may be mixed with a resin that burns and disappears when heated, and used as a Zn compound layer other than a ZnO film or as a metallic Zn layer. The amount of Zn included in the Zn compound layer or the metallic Zn layer is adjusted in accordance with a deposited amount of a ZnO film in a desired product.

ZnO Film

The ZnO film is a film which forms a surface that comes into contact with the die and which will form the outer surface of the press-formed product.

The method used for forming the ZnO film is not particularly limited, and the ZnO film can be formed on the GA plating layer, for example, by a method disclosed in Patent Document 1 or 2.

The deposited amount of the ZnO film is preferably adjusted within the range of from 0.4 to 4.0 g/m$^2$ in terms of Zn amount, from the viewpoint of the corrosion resistance of the product. When the deposited amount of the ZnO film is adjusted to 0.4 g/m$^2$ or more in terms of Zn amount, the corrosion resistance of the resulting press-formed product improves. When the deposited amount of the ZnO film is adjusted to more than 4.0 g/m$^2$ in terms of Zn amount, the total thickness of the GA plating layer and the ZnO film becomes too large, which may deteriorate weldability and paint adhesion. The deposited amount of the ZnO film is more preferably from 0.4 to 2.0 g/m$^2$ in terms of Zn amount. When the deposited amount of the GA plating layer is low, the deposited amount of the ZnO film is preferably adjusted to a larger value within the above-described range, from the viewpoint of wear of the die.

The deposited amount of the ZnO film is measured using the X-ray fluorescence method. Specifically, a calibration curve is prepared using several kinds of standard samples each having a ZnO film in a known deposited amount (in terms of Zn amount), using the X-ray fluorescence method. Thereafter, the Zn intensity of a sample to be measured is converted to the deposited amount of the ZnO film, based on the calibration curve, to determine the deposited amount of the ZnO film.

(Press-Formed Product)

Next, the press-formed product according to the present embodiment will be described in detail.

The press-formed product according to the present embodiment is a press-formed product made of a steel sheet. The steel sheet of the press-formed product includes a steel base material, a hot-dip galvannealed (GA plating) layer provided on the steel base material, and a zinc oxide (ZnO) layer, as an outermost surface layer, provided on the GA plating layer.

The zinc oxide (ZnO) layer, as an outermost surface layer, is formed by the heating performed during hot press forming of the GA plated steel sheet.

The steel base material (steel sheet) has a hardness Hv_Parts of HV 400 or more, preferably HV 450 or more, and more preferably HV 550 or more, from the viewpoint of obtaining high mechanical strength.

Further, the press-formed product according to the present embodiment includes: a top wall portion; a vertical wall portion connected to the top wall portion via a first ridge portion; and a flange portion connected to the vertical wall portion via a second ridge portion. The press-formed product according to the present embodiment is, for example, the hot press-formed product 40 which has the shape shown in FIG. 3A and FIG. 3B having a hat-shaped cross section with a flat top wall portion, or the hot press-formed product 30 which has the shape shown in FIG. 2A and FIG. 2B.

—Press-Formed Product According to First Aspect—

First, a press-formed product according to a first aspect is described which is a press-formed product including the portion PB0$_{min}$ at which the curvature radius of the flange portion is smallest, when the press-formed product is projected from a direction orthogonal to the longitudinal direction of the press-formed product and parallel to a top wall portion. The formed product shown in FIG. 2A and FIG. 2B is one example of the press-formed product according to the first aspect.

The hot press-formed product 30 shown in FIG. 2A and FIG. 2B includes: two vertical wall portions 33; the top wall portion 31 which connects the two vertical wall portions 33 via the first ridge portions 32; and the flange portions 35 respectively connected to the two vertical wall portions 33 respectively via the second ridge portions 34, at a side opposite to the top wall portion 31. The top wall portion 31 is a portion which corresponds to the top surface of the punch in hot press forming, the vertical wall portions 33 are portions which slide against the punch and the die, and the flange portions 35 are portions which are not formed at the time of hot press forming. The first ridge portions 32 are curved portions connecting the top wall portion 31 and the vertical wall portions 33, and the second ridge portions 34 are curved portions respectively connecting the vertical wall portions 33 and the flange portions 35.

When the press-formed product 30 is projected from a direction orthogonal to the longitudinal direction of the press-formed product 30 and parallel to the top wall portion 31 (for example, when observed from the y-direction as shown in FIG. 2B), each of the top wall portion 31, the vertical wall portion 33 and the flange portion 35 is curved at a part thereof, and the hot press-formed product 30 has a shape of which a part is bulging in the direction toward the outer side of the top wall portion 31. Therefore, the flange portion 35 at the bulging portion includes the portion PB0$_{min}$ at which the curvature radius is smallest (namely, the portion having the largest curvature). When the hot press-formed product 30 is projected from a direction orthogonal to the longitudinal direction of the press-formed product 30 and parallel to the top wall portion 31, the flange portion 35, as a whole, does not have a constant curvature radius, and the top wall portion 31 as a whole, also does not have a constant curvature radius.

Curvature Radius at Second Ridge Portion (First Aspect)

In the press-formed product according to the first aspect, the portion of the second ridge portion 34 at which the curvature radius is smallest (namely, the portion having the largest curvature) has a curvature radius [$R_{min}$] of from 3 mm to less than 10 mm. That the minimum curvature radius [$R_{min}$] at the second ridge portion 34 is less than 10 indicates that, when the press-formed product 30 is produced by performing hot press forming on a GA plated steel sheet, the portion which will become the vertical wall portion 33 undergoes a high surface pressure. Therefore, it can be said that this press-formed product has been subjected to hot press forming under conditions in which the vertical wall portion 33 experiencing a high surface pressure is susceptible to scratches due to sliding. When the upper limit value of the minimum curvature radius [$R_{min}$] at the second ridge portion 34 is 8 mm or less, it can be said that the vertical wall portion 33 is more likely to have scratches due to sliding.

The lower limit value of the minimum curvature radius [$R_{min}$] at the second ridge portion 34 is 3 mm or more, and preferably 4 mm or more, from the viewpoint of preventing cracks during press forming.

The curvature radius as used herein is measured as follows. First, the three-dimensional shape of the outer surfaces of the second ridge portions 34, namely, the three-dimensional shape of the surfaces which have contacted the die during the hot press forming, is measured by a three-dimensional shape measuring apparatus. Thereafter, the curvature radius [$R_{min}$] at the portion at which the curvature radius in a transverse cross section is smallest is determined.

Difference in Smoothness Between Top Wall Portion and Vertical Wall Portion (First Aspect)

In the press-formed product according to the first aspect, there is a difference in smoothness between the top wall portion 31 and the vertical wall portion 33. Specifically, the smoothness [SaB1] of the top wall portion 31 is measured at a central portion PB1$_{min}$. The central portion PB1$_{min}$ is a portion corresponding to the portion PB0$_{min}$ at which the curvature radius of the flange portion 35 when the hot press-formed product 30 is projected from a direction orthogonal to the longitudinal direction of the press-formed product 30 and parallel to the top wall portion 31 (for example, when observed from the y-direction as shown in FIG. 2B) is smallest (for example, the central portion PB1$_{min}$ is a portion on the top wall portion 31 that can be reached simply by shifting in the z-direction without any shift in the x-direction, from the portion PB0$_{mm}$ on the flange portion 35, when observed from the y-direction as shown in FIG. 2B), and the central portion PB1$_{min}$ is also a central portion in the width direction (namely, the y-direction) of the top wall portion 31.

Further, the smoothness [SaB2] of the vertical wall portion 33 is measured at a central portion PB2$_{min}$. The central portion PB2$_{min}$ is a portion corresponding to the portion PB0$_{min}$ when the hot press-formed product 30 is projected from a direction orthogonal to the longitudinal direction of the press-formed product 30 and parallel to the top wall portion 31 (namely, the central portion PB2$_{min}$ is a portion on the vertical wall portion 33 that can be reached simply by shifting in the z-direction without any shift in the x-direction, from the portion PB0$_{min}$ on the flange portion 35, when observed from the y-direction as shown in FIG. 2B), and the central portion PB2$_{min}$ is also a central portion in the height direction (namely, the z-direction) of the vertical wall portion 33.

Each of the smoothness at the portion PB1$_{min}$ and the smoothness at the portion PB2$_{min}$ is measured on the outer surface, namely, the surface which has contacted the die during the hot press forming.

The difference [SaB1−SaB2] is 0.25 μm or more.

In other words, in the transverse cross-section of the press-formed product 30 including the portion PB0$_{mm}$ where the curvature radius of the flange portion when the press-formed product 31 is projected from a direction orthogonal to the longitudinal direction of the press-formed product 30 and parallel to the top wall portion 31 is smallest, the difference [SaB1−SaB2] between the smoothness [SaB1] at the central portion PB1$_{min}$, which is the central portion in the width direction of the top wall portion 31, and the smoothness [SaB2] at the central portion $PB2_{min}$, which is the central portion in the height direction of the vertical wall portion 33, is 0.25 μm or more.

A difference [SaB1−SaB2] in smoothness between the top wall portion 31 and the vertical wall portion 33 within this range indicates that, when the press-formed product 30 was produced by performing hot press forming on a GA plated steel sheet, a portion of the steel sheet which would become the vertical wall portion 33 experienced a high surface pressure, as compared to the portion which would become the top wall portion 31. This is because sliding of the vertical wall portion 33 against the die with a high surface pressure causes the surface of the vertical wall portion 33 to become smoother than the surface of the top wall portion 31. Therefore, it can be said that this press-formed product was formed by hot press forming under conditions such that the vertical wall portion 33 experiencing a high surface pressure was susceptible to scratches due to sliding. When the difference [SaB1−SaB2] in the smoothness is 0.35 μm or more, it can be said that the vertical wall portion 33 is more likely to have scratches due to sliding.

The upper limit value of the difference [SaB1−SaB2] in the smoothness is more preferably 1.0 μm or less, from the viewpoint of sharpness after painting.

Each of the smoothnesses [SaB1] and [SaB2] refers to an arithmetic mean height Sa (unit: μm) defined in ISO 25178-2 (2012). The measuring apparatus, the measurement conditions and the like are as follows.

Measuring apparatus: a shape analysis laser microscope VK-X 250/150 manufactured by Keyence Corporation Measurement region: a 5 mm×5 mm region with the central point of $PB1_{min}$ or $PB2_{min}$ located at the center of the measurement region Measurement conditions: Gaussian filter was used S filter: not used L filter: 4 mm Difference in Surface Texture Aspect Ratio Between Top Wall Portion and Vertical Wall Portion (First Aspect)

In the press-formed product according to the first aspect, the difference in surface texture aspect ratio between the top wall portion 31 and each vertical wall portion 33 is small. Specifically, the surface texture aspect ratio of the top wall portion 31 and the surface texture aspect ratio of the vertical wall portion 33 are measured at the portion $PB1_{min}$ and at the portion $PB2_{min}$, respectively, to obtain a surface texture aspect ratio [StrB1] and a surface texture aspect ratio [StrB2], respectively, as with the measurement of smoothness. As with the measurement of smoothness, each of the surface texture aspect ratios is measured on the outer surface, namely, the surface which has contacted the die during the hot press forming.

The difference [StrB1−StrB2] is 0.50 or less.

A smaller difference [StrB1−StrB2] in the surface texture aspect ratio between the top wall portion 31 and the vertical wall portion 33 indicates that the occurrence of scratches due to sliding is reduced in the vertical wall portion 33 in the press-formed product, even though the portion which would become the vertical wall portion 33 experienced a higher surface pressure during the hot press forming, than the portion which would become the top wall portion 31. When scratches due to sliding have significantly occurred at a given portion, the surface texture aspect ratio Str at the portion decreases because the scratches are in the form of streaks. Further, the portion at which the scratches have occurred forms a glossy part before painting. After painting, since a difference in glossiness is generated, the scratched portion appears like a pattern when visually observed, resulting in poor surface quality. In contrast, by regulating the difference [StrB1−StrB2] in the surface texture aspect ratio to be small, it is possible to obtain a press-formed product according to the first aspect in which the difference in glossiness after painting is 25 or less, and the press-formed product has excellent surface quality.

In a press-formed product formed using a high-hardness steel base material having a hardness Hv_Parts of HV 400 or more, delayed fracture is more likely to occur due to hydrogen embrittlement or the like, particularly at a portion at which stress is concentrated during the press forming. However, in the press-formed product according to the first aspect, it can be said that the concentration of stress to the vertical wall portion 33 is also mitigated, because the occurrence of scratches in the vertical wall portion 33 is reduced as described above. Accordingly, delayed fracture, which tends to occur at a stress-concentrated portion, is also reduced.

Further, the difference [StrB1−StrB2] in surface texture aspect ratio is preferably 0.50 or less, and more preferably 0.40 or less, from the viewpoint of obtaining excellent surface quality and reducing delayed fracture.

Each of the surface texture aspect ratios [StrB1] and [StrB2] refers to the surface texture aspect ratio "Str" defined in ISO 25178-2 (2012). The measuring apparatus, the measurement conditions and the like are as follows.

Measuring apparatus: a shape analysis laser microscope VK-X 250/150 manufactured by Keyence Corporation Measurement region: a 5 mm×5 mm region with the central point of $PB1_{min}$ or $PB2_{min}$ located at the center of the measurement region Measurement conditions: Gaussian filter was used S filter: not used L filter: 4 mm The method used for adjusting the difference [StrB1−StrB2] in surface texture aspect ratio between the top wall portion 31 and the vertical wall portion 33 within the above-described range is not particularly limited, and may be a method in which a press-formed product is formed by the above-described method of producing a hot press-formed product according to the present embodiment.

When a press-formed product is formed using the method of producing a hot press-formed product according to the present embodiment, adhesion to the die can be reduced. A large amount of adhesion causes an increase in friction coefficient, making scratches due to sliding more likely to occur. However, when the amount of adhesion is reduced as described above, an increase in friction coefficient is also curbed, and the occurrence of scratches due to sliding in the vertical wall portion 33 is reduced. It is conceivable that the difference [Str1−Str2] in surface texture aspect ratio can be controlled within the above-described range due to the above mechanism.

—Press-Formed Product According to Second Aspect—

Next, a press-formed product according to the second aspect will be described. A formed product shown in FIG. 3A and FIG. 3B as well as a formed product shown in FIG. 4A and FIG. 4B are examples of the press-formed product according to the second aspect.

The hot press-formed product 40 shown in FIG. 3A and FIG. 3B includes: two vertical wall portions 43; a flat top wall portion 41 which connects the two vertical wall portions 43 via first ridge portions 42; and flange portions 45 respectively connected to the two vertical wall portions 43 respectively via second ridge portions 44, at a side opposite to the top wall portion 41. The top wall portion 41 is a portion which corresponds to the top surface of the punch in hot press forming, the vertical wall portions 43 are portions which slide against the punch and the die, and the flange portions 45 are portions which are not formed at the time of hot press forming. The first ridge portions 42 are curved portions connecting the top wall portion 41 and the vertical wall portions 43, and the second ridge portions 44 are curved portions respectively connecting the vertical wall portions 43 and the flange portions 45.

When the hot press-formed product 40 is observed from the side surface side, namely, observed from the y-direction as shown in FIG. 3A, all of the top wall portion 41, the vertical wall portion 43 and the flange portion 45 are flat. This hot press-formed product 40 has a shape having left-right symmetry in any transverse cross section regardless of the position to be sectioned, when a cross section (transverse cross section, such as the cross section shown in FIG. 3B) of the hot press-formed product 40 orthogonal to the longitudinal direction (the x-direction) is observed. Further, the hot press-formed product 40 has a shape such that each second ridge portion 44 has the same curvature radius value in any transverse cross section regardless of the position to be sectioned. In other words, each second ridge portion 44 has a constant curvature radius in any transverse cross section regardless of the position to be sectioned. To put it in another way, the curvature radius of each second ridge portion 44 is the smallest value, in any transverse cross section regardless of the position to be sectioned.

The hot press-formed product 50 shown in FIG. 4A and FIG. 4B is a center pillar for use in an automobile, and includes: two vertical wall portions 53*a* and 53*b*; a flat top wall portion 51 which connects the two vertical wall portions 53*a* and 53*b* via first ridge portions 52*a* and 52*b*, respectively; flange portions 55*a* and 55*b* connected to the two vertical wall portions 53*a* and 53*b* via second ridge portions 54*a* and 54*b*, respectively, at a side opposite to the top wall portion 51. The top wall portion 51 is a portion which corresponds to the top surface of the punch in hot press forming, the vertical wall portions 53*a* and 53*b* are portions which slide against the punch and the die, and the flange portions 55*a* and 55*b* are portions which are not formed at the time of hot press forming. The first ridge portions 52*a* and 52*b* are curved portions connecting the top wall portion 51 and the vertical wall portions 53*a* and 53*b*, respectively, and the second ridge portions 54*a* and 54*b* are curved portions connecting the vertical wall portions 53*a* and 53*b* and the flange portions 55*a* and 55*b*, respectively.

The hot press-formed product 50 includes a portion of which cross section (transverse cross section) orthogonal to the longitudinal direction (the x-direction) has a shape that does not have left-right symmetry. For example, in the transverse cross section shown in FIG. 4B, the heights in the z-direction of the two first ridge portions 52*a* and 52*b* present at respective sides of the flat top wall portion 51 are different, and the first ridge portion 52*a* on the right side bulges higher in the z-direction than the first ridge portion 52*b* on the left side. Further, in the transverse cross section shown in FIG. 4B, the heights in the z-direction of the two flange portions 55*a* and 55*b* are also different, and the flange portion 55*a* at the right side is higher than the flange portion 55*b* at the left side. The hot press-formed product 50 has a shape such that curvature radii of the second ridge portions 54*a* and 54*b* in a transverse cross section vary with the position to be sectioned, and such that the curvature radius of the second ridge portion 54*a* is smallest at the transverse cross section shown in FIG. 4B (cross section along the line B-B' in FIG. 4A).

Curvature Radius at Second Ridge Portion (Second Aspect)

In the press-formed product according to the second aspect, the portion of the second ridge portion 44, 54*a* or 54*b* at which the curvature radius is smallest (namely, the portion having the largest curvature) has a curvature radius [$R_{min}$] of from 3 mm to less than 10 mm. That the minimum curvature radius [$R_{min}$] at the second ridge portion 44, 54*a* or 54*b* is less than 10 indicates that, when the press-formed product 40 or 50 is produced by performing hot press forming on a GA plated steel sheet, the portion which will become the vertical wall portion 43, 53*a* or 53*b* undergoes a high surface pressure. Therefore, it can be said that this press-formed product has been subjected to hot press forming under conditions in which the vertical wall portion 43, 53*a* or 53*b* experiencing a high surface pressure is susceptible to scratches due to sliding. When the upper limit value of the minimum curvature radius [$R_{min}$] at the second ridge portion 44, 54*a* or 54*b* is 8 mm or less, it can be said that the vertical wall portion 43, 53*a* or 53*b* is more likely to have scratches due to sliding.

The lower limit value of the minimum curvature radius [Renin] at the second ridge portion 44, 54*a* or 54*b* is 3 mm or more, and preferably 4 mm or more, from the viewpoint of preventing cracks during press forming.

The curvature radius is measured in accordance with the method used for measuring the curvature radius of the second ridge portion in the above-described first aspect.

Difference in Smoothness Between Top Wall Portion and Vertical Wall Portion (Second Aspect)

In the press-formed product according to the second aspect, there is a difference in smoothness between the top wall portion and the vertical wall portion. Specifically, when a cross section (transverse cross section) of the press-formed product in a direction orthogonal to the longitudinal direction (the x-direction) is observed, a transverse cross section of the press-formed product at which the curvature radius of the second ridge portion is smallest is selected as the cross section to be measured. In other words, in the case of the press-formed product 40 shown in FIG. 3A and FIG. 3B, the curvature radius of each second ridge portion 44 is the smallest value, in any transverse cross section regardless of the position to be sectioned, and, therefore, any transverse cross section may be used as the cross section to be measured. Preferably, it is recommended to use the transverse cross section at a central position in the longitudinal direction (the x-direction). In the case of the press-formed product 50 shown in FIG. 4A and FIG. 4B, the curvature radius of the second ridge portion 54*a* is smallest in the transverse cross section shown in FIG. 4B (the cross section along the line B-B' in FIG. 4A), and thus the transverse cross section shown in FIG. 4B is used as the cross section to be measured. Thereafter, in the thus selected transverse cross section at which the curvature radius is smallest, a smoothness [SaA1] is measured at a central portion $PA1_{min}$, which is the central portion in the cross-sectional width direction of the top wall portion (41 or 51) (for example, in FIG. 3B, the smoothness is measured at the portion corresponding to a midpoint (W/2) of the length W in the y-direction of the top wall portion 41).

Also for the vertical wall portion, a transverse cross section at which the curvature radius of the second ridge portion is smallest when cross sections (transverse cross sections) in a direction orthogonal to the longitudinal direction (the x-direction) of the press-formed product are observed, is selected as the cross section to be measured. Thereafter, in the thus selected transverse cross section at which the curvature radius is smallest, a smoothness [SaA2] is measured at a central portion $PA2_{min}$, which is the central portion in the cross-sectional height direction of the vertical wall portion (43 or 53*a*) (for example, in FIG. 3B, the smoothness is measured at the portion corresponding to a midpoint (H/2) of the length H in the z-direction of the vertical wall portion 43).

Each of the smoothness at the portion $PA1_{min}$ and the smoothness at the portion $PA2_{min}$ is measured on the outer surface, namely, the surface which has contacted the die during the hot press forming.

The difference [SaA1−SaA2] is 0.25 μm or more.

In other words, in the transverse cross-section of the press-formed product where the curvature radius of the second ridge portion is smallest, the difference [SaA1−SaA2] between the smoothness [SaA1] at the central portion $PA1_{min}$, which is a central portion in the width direction of the transverse cross section of the top wall portion, and the smoothness [SaA2] at the central portion $PA2_{min}$, which is a central portion in the height direction of the transverse cross section of the vertical wall portion, is 0.25 μm or more.

The difference [SaA1−SaA2] in smoothness between the top wall portion and the vertical wall portion within this range indicates that when the press-formed product was produced by performing hot press forming on a GA plated steel sheet, a portion of the steel sheet which would become the vertical wall portion experienced a higher surface pressure than the portion which would become the top wall portion. This is because sliding of the vertical wall portion against the die with a high surface pressure causes the surface of the vertical wall portion to become smoother than the surface of the top wall portion. Therefore, it can be said that this press-formed product was formed by hot press forming under conditions such that the vertical wall portion to which a high surface pressure is applied is susceptible to scratches due to sliding. When the difference [SaA1−SaA2] in smoothness is 0.45 μm or more, it can be said that the vertical wall portion is more likely to have scratches due to sliding.

The upper limit value of the difference [SaA1−SaA2] in smoothness is more preferably 1.0 μm or less, from the viewpoint of sharpness after painting.

Each of the smoothnesses [SaA1] and [SaA2] refers to an arithmetic mean height Sa (unit: μm) defined in ISO 25178-2 (2012). The measuring apparatus, the measurement conditions and the like are as follows.

Measuring apparatus: a shape analysis laser microscope VK-X 250/150 manufactured by Keyence Corporation Measurement region: a 5 mm×5 mm region with the central point of $PA1_{min}$ or $PA2_{min}$ located at the center of the measurement region Measurement conditions: Gaussian filter was used S filter: not used L filter: 4 mm Difference in Surface Texture Aspect Ratio Between Top Wall Portion and Vertical Wall Portion (Second Aspect)

In the press-formed product according to the second aspect, the difference in surface texture aspect ratio between the top wall portion and the vertical wall portion is small. Specifically, the surface texture aspect ratio of the top wall portion (41 shown in FIG. 3B or 51 shown in FIG. 4B) and the surface texture aspect ratio of the vertical wall portion (43 shown in FIG. 3B, or 53*a* shown in FIG. 4B) are measured at the portion $PA1_{min}$ and at the portion $PA2_{min}$, respectively, to obtain a surface texture aspect ratio [StrA1StrA1] and a surface texture aspect ratio [StrA2], respectively, as with the measurement of smoothness. As with the measurement of smoothness, each of the surface texture aspect ratios is measured on the outer surface, namely, the surface which has contacted the die during the hot press forming.

The difference [StrA1−StrA2] is 0.50 or less.

A smaller difference [StrA1−StrA2] in surface texture aspect ratio between the top wall portion and the vertical wall portion indicates that the occurrence of scratches due to sliding is reduced in the vertical wall portion in the press-formed product, even though the portion which would become the vertical wall portion experienced a higher surface pressure during the hot press forming, than the portion which would become the top wall portion. When scratches due to sliding have significantly occurred at a given portion, the surface texture aspect ratio Str at the portion decreases because the scratches are in the form of streaks. Further, the portion at which the scratches have occurred forms a glossy part before painting. After painting, since a difference in glossiness is generated, the scratched portion appears like a pattern when visually observed, resulting in poor surface quality. In contrast, by regulating the difference [StrA1−StrA2StrA2] in surface texture aspect ratio to be small, it is possible to obtain a press-formed product according to the second aspect in which the difference in glossiness after painting is 25 or less, and the press-formed product has excellent surface quality.

In a press-formed product formed using a high-hardness steel base material having a hardness Hv_Parts of HV 400 or more, delayed fracture is more likely to occur due to hydrogen embrittlement or the like, particularly at a portion at which stress is concentrated during the press forming. However, in the press-formed product according to the second aspect, it can be said that the concentration of stress to the vertical wall portion is also mitigated, because the occurrence of scratches in the vertical wall portion is reduced as described above. Accordingly, delayed fracture, which tends to occur at a stress-concentrated portion, is also reduced.

Further, the difference [StrA1−StrA2] in surface texture aspect ratio is preferably 0.50 or less, and more preferably 0.40 or less, from the viewpoint of obtaining excellent surface quality and reducing delayed fracture.

Each of the surface texture aspect ratios [StrA1] and [StrA2] refers to the surface texture aspect ratio Str defined in ISO 25178-2 (2012). The measuring apparatus, the measurement conditions and the like are as follows.

Measuring apparatus: a shape analysis laser microscope VK-X 250/150 manufactured by Keyence Corporation Measurement region: a 5 mm×5 mm region with the central point of $PA1_{min}$ or $PA2_{min}$ located at the center of the measurement region Measurement conditions: Gaussian filter was used S filter: not used L filter: 4 mm The method used for adjusting the difference [StrA1−StrA2] in surface texture aspect ratio between the top wall portion and the vertical wall portion within the above-described range is not particularly limited, and may be a method in which a press-formed product is formed by the above-described method of producing a hot press-formed product according to the present embodiment.

When a press-formed product is formed using the method of producing a hot press-formed product according to the present embodiment, adhesion to the die can be reduced. A large amount of adhesion causes an increase in friction coefficient, making scratches due to sliding more likely to occur. However, when the amount of adhesion is reduced as described above, an increase in friction coefficient is also curbed, and the occurrence of scratches due to sliding in the vertical wall portion is reduced. It is conceivable that the difference [Str1−Str2] in surface texture aspect ratio can be controlled within the above-described range due to the above mechanism.

Average Thickness of Zinc Oxide Layer (First and Second Aspects)

In the press-formed products according to the first and second aspects, the zinc oxide (ZnO) layer, which is an outermost surface layer, preferably has an average thickness of from 0.3 μm to 2.0 μm, and more preferably from 0.4 μm to 1.5 μm.

The average thickness as used herein refers to the average thickness of the ZnO layer measured at a portion at which sliding against the die at the time of hot press forming was small, specifically, the average thickness of the ZnO layer at the inner side of the top wall portion 31, 41, or 51 in the case of the press-formed product 30, 40, or 50 shown in FIG. 2A, FIG. 3B, or FIG. 4B.

When the average thickness of the ZnO layer is 0.3 μm or more, adhesion to the die during hot press forming can be reduced. When the average thickness of the ZnO layer is 2.0 μm or less, excellent weldability can be obtained, and, also, a high corrosion resistance can be maintained because the GA plating layer is prevented from being too thin.

The average thickness of the ZnO layer may be controlled by adjusting the holding time of heating during hot press forming or by applying a ZnO film before forming.

The average thickness of the ZnO layer is measured at a portion at which sliding against the die at the time of hot press forming was small, as described above. Specifically, the measurement of the thickness is performed as follows.

The press-formed product is cut in a transverse cross section, and the plating layer structure at the outermost surface layer of the top wall portion in the cross section is observed and analyzed using an electron microscope JSM-7001F manufactured by JEOL Ltd. Thereafter, the thickness of the ZnO layer present at the outermost surface is measured in a sheet thickness direction, at a portion at which the ZnO layer thickness is largest.

The measurement is performed at randomly selected three points at the inner side of the top wall portion, and the average of the measured values is calculated.

EXAMPLES

Next, the present disclosure will be described in further detail, with reference to examples. It is noted, however, that the present disclosure is in no way limited to the following Examples.

<<Preparation of Plated Steel Sheets>>

<GA Plated Steel Sheet (G1)>

A cold-rolled steel sheet (including, in % by mass, C: 0.21%, Si: 0.12%, Mn: 1.21%, P: 0.02%, S: 0.012%, Ti: 0.02%, B: 0.03%, Al: 0.04%, and the balance: Fe and impurities) having a thickness of 1.6 mm was prepared as a steel base material, and a GA plating layer was formed on both sides of this steel base material by GA plating using a reduction furnace method.

First, a steel base material was pretreated by alkaline degreasing, followed by hot rinsing (hot water washing) and drying with a dryer. The pretreated steel base material was then placed in a reduction furnace, annealed under a reducing atmosphere, and cooled. A GA plating (hot-dip galvannealed) layer was formed by forming a hot-dip galvanizing layer on this steel base material and performing alloying treatment with heating. A test piece of a GA plated steel sheet (A1) was thus obtained.

The component composition of the GA plating layer includes, in % by mass, 10% of Fe, 0.1% of Al, with the balance being Zn and impurities.

<GA Plated Steel Sheet (G2)>

A test piece of a GA-plated steel sheet was obtained in the same manner as the GA-plated steel sheet (G1), except that the deposited amounts (areal weights) on the upper and lower surfaces of the GA-plated layer were changed as shown in Table 1 below.

<GA Plated Steel Sheet (G3)>

A ZnO film was further formed on the GA-plated steel sheet (G1). Specifically, on the GA plating layer provided on each side, a chemical solution (NANOTEK SLURRY, manufactured by C.I. Kasei Co., Ltd.; particle size of zinc oxide particles=70 nm) was applied using a roll coater, and the coating was baked at about 80° C., to form a ZnO film having a deposited amount (in terms of Zn amount) of 0.5 g/m$^2$ on each side, and a test piece of a GA plated steel sheet was obtained.

TABLE 1

| | Plating layer | | Film | | |
|---|---|---|---|---|---|
| | | | | Deposited amount | |
| No. | Type of plating | Areal weight (upper surface/lower surface) [g/m$^2$] | Type of film | (in terms of Zn amount) (upper surface/lower surface) [g/m$^2$] | Hardness HV of material surface |
| G1 | GA plating | 45/45 | | Absent | 300 |
| G2 | GA plating | 70/70 | | Absent | 300 |
| G3 | GA plating | 45/45 | ZnO | 0.5/0.5 | 330 |

Example A

<<Preparation of Dies>>

Condition No. 1: Comparative Example 1

Base Material

A steel of which the material is indicated in Table 2 was prepared, and, in an annealing state, roughly formed into shapes close to the shape of an upper die 102A and the shape of a lower die 102B, respectively, illustrated in FIG. 6. Thereafter, the shaped steel blocks were quenched by being held under heating at 1,180° C. in vacuum and then cooled with nitrogen gas, and then the shaped steel blocks were refined to 64 HRC by tempering within the range of from 540 to 580° C. Subsequently, finishing processing was performed to obtain base materials of the die.

The base materials were used, as they were, as a die (an upper die 102A and a lower die 102B) without forming a nitride layer and a PVD film.

The skewness (Rsk) of the steel sheet contact surface of the resulting die in the sliding direction of the contacting (sliding) plated steel sheet 10 was measured in accordance with the above-described method. Further, the hardness Hv_Die of the steel sheet contact surface of the resulting die was measured in accordance with the above-described method.

Further, the evaluations described below were performed using the plated steel sheet and the die indicated in Table 2.

Condition No. 2: Example 1

Formation of Nitride Layer

A nitride layer was formed on the steel sheet contact surfaces of the base materials (the upper die 102A and the lower die 102B) obtained in Condition No. 1 that are configured to contact (slide against) the plated steel sheet 10.

Specifically, each of the base materials was subjected to an ion nitriding treatment under the conditions shown below. Specifically, after performing an ion nitriding treatment under the conditions including an atmosphere including $N_2$ at a flow rate ratio of 5% (with remaining portion being $H_2$), a temperature of 500° C., and a holding time of 5 hours, each test surface was finished by polishing, to form a nitride layer.

Here, the above-described polishing was performed by sliding a polishing sheet in a direction in which the plated steel sheet 10 was to contact (slide against) the steel sheet contact surface.

The skewness (Rsk) of the steel sheet contact surface of the resulting die in the plated steel sheet 10 sliding direction and the hardness Hv_Die of the steel sheet contact surface of the resulting die are indicated in Table 2. Furthermore, the evaluations described below were performed using the plated steel sheet and the die indicated in Table 2.

Condition Nos. 3 to 4: Examples 2 to 3

The processes of Condition No. 2 were modified such that the degree of polishing of the nitride layer was changed to adjust the skewness (Rsk) of the steel sheet contact surface of each die in a direction in which the plated steel sheet 10 was to slide against the steel sheet contact surface to the values indicated in Table 2 below, as a result of which dies (upper dies 102A and lower dies 102B) were prepared.

Furthermore, the evaluations described below were performed using the plated steel sheets and the dies indicated in Table 2.

Condition No. 5: Example 4

The processes of Condition No. 2 were modified such that a nitride layer was formed without performing the polishing of the test surface after performing the ion nitriding treatment. A PVD film as a hard coating layer was then formed on the nitride layer.

Formation of PVD Film

To the portion of each base material provided with the nitride layer, a bias voltage of −400 V was applied in an Ar atmosphere at a pressure of 0.5 Pa using an arc ion plating apparatus, and plasma cleaning with the hot filament was performed for 60 minutes. Thereafter, a PVD film was formed using a metal target as an evaporation source of a metal component or metal components, and using $N_2$ gas as a reaction gas, at a base material temperature of 500° C., a reaction gas pressure of 3.0 Pa, and a bias voltage of −50V. The metal target used as the source of evaporation had a metal composition capable of forming a PVD film having the composition indicated in Table 2.

After the PVD film was formed, polishing was performed by sliding a polishing sheet in a direction in which the plated steel sheet 10 was to contact (slide against) the steel sheet contact surface.

The skewness (Rsk) of the steel sheet contact surface of the resulting die in the plated steel sheet 10 sliding direction and the hardness Hv_Die of the steel sheet contact surface of the resulting die are indicated in Table 2. Furthermore, the evaluations described below were performed using the plated steel sheet and the die indicated in Table 2.

Conditions Nos. 6 to 13, 15 to 16: Examples 5 to 9 and Comparative Examples 2 to 6

The processes of Condition No. 5 were modified such that the composition of the PVD film indicated in Table 2 was used, and such that the hardness of the PVD film was adjusted to the value indicated in Table 2, and such that the degree of polishing of the PVD film was changed to adjust the skewness (Rsk) of the steel sheet contact surface of the die in the plated steel sheet 10 sliding direction to the values indicated in Table 2, as a result of which dies (upper dies 102A and lower dies 102B) were prepared.

Furthermore, the evaluations described below were performed using the plated steel sheets and the dies indicated in Table 2.

Condition No. 14: Comparative Example 7

A die (an upper die 102A and a lower die 102B) was prepared by modifying the processes of Condition No. 1 by changing the degree of polishing of the steel sheet contact surface, such that the skewness (Rsk) of the steel sheet contact surface of the die in the plated steel sheet 10 sliding direction to the value indicated in Table 2.

Furthermore, the evaluations described below were performed using the plated steel sheet and the die indicated in Table 2.

<Evaluations>

Die Wear

First, an apparatus for evaluating hot lubricity was prepared. The apparatus for evaluating hot lubricity shown in FIG. 8 includes: a near-infrared furnace 100; and a die composed of an upper die 102A and a lower die 102B. Each of the upper die 102A and the lower die 102B includes a protruding portion extending in a direction orthogonal to a drawing direction of the plated steel sheet and having a width of 10 mm. The upper and the lower dies apply a predetermined pressing load by sandwiching a sample material between the top surfaces of the protruding portions of the upper and lower dies. The apparatus for evaluating hot lubricity is provided with a thermocouple (not shown) for measuring the temperature of a plated steel sheet at the time of being heated in the near-infrared furnace 100, and the temperature of the plated steel sheet at the time of being sandwiched between the dies. The reference numeral 10 shown in FIG. 8 indicates a sample material of the plated steel sheet.

Figure 8:
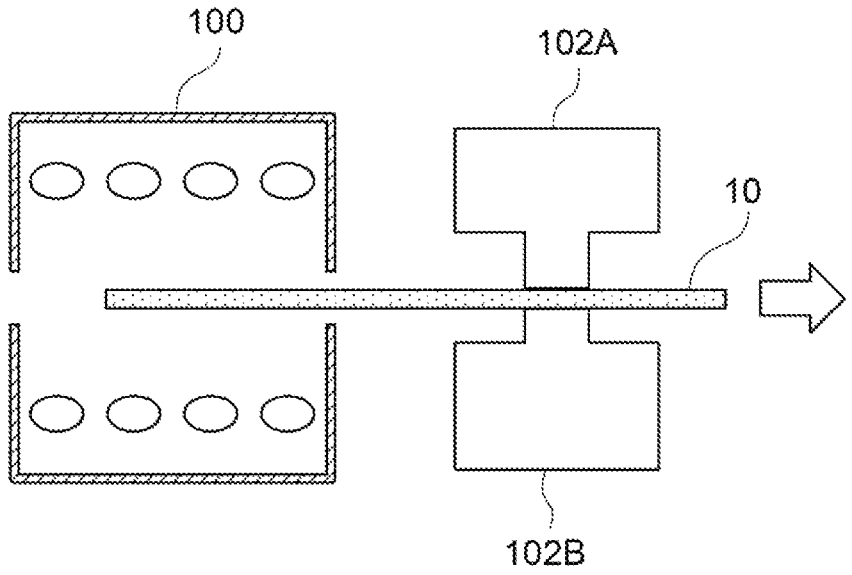
FIG. 8 is a schematic structural diagram illustrating an apparatus for evaluating hot lubricity.

Using the apparatus for evaluating hot lubricity shown in FIG. 8, a sample material having a size of 30 mm×500 mm was heated to 920° C. in a nitrogen atmosphere in the near-infrared furnace 100. Thereafter, the sample material, the temperature of which became about 700° C., was drawn through the die composed of the upper die 102A and the lower die 102B while a pressing load of 3 kN was applied to the sample material (namely, while allowing the sample material to slide against the die), wherein the drawing length was set at 100 mm, and the drawing speed was set at 40 mm/s. During the heating of the sample material to 920° C., the average rate of temperature rise was set at 7.5° C./sec.

The difference in surface profile between the steel sheet contact surface of the die in the apparatus for evaluating hot lubricity before the test for evaluating hot lubricity described above was performed and the steel sheet contact surface after the test for evaluating hot lubricity was performed was analyzed to measure the amount of die wear, the steel sheet contact surface being a surface that came into contact with (slid against) the plated steel sheet 10. Specifically, the profile of the die surface in the sliding portion was measured before and after sliding, using a contact-type shape measuring apparatus, to determine the amount of die wear. An average amount of die wear was calculated from the respective surface profiles of the upper die and the lower die, and the calculated average value was taken as the amount of die wear.

The evaluation was performed based on the thus determined amount of die wear, in accordance with the following evaluation criteria.

A: the amount of die wear is 0.5 μm or less

B: the amount of die wear is from more than 0.5 μm to 1 μm

C: the amount of die wear is from more than 1 μm to 2 μm

D: the amount of die wear is more than 2 μm

C: the maximum adhesion height on the die is from more than 1 μm to 3 μm

D: the maximum adhesion height on the die is more than 3 μm

Friction Coefficient

The friction coefficient between the die and the steel sheet was evaluated by the following test.

The friction coefficient between the steel sheet contact surface of the die in the apparatus for evaluating hot lubricity after the above-described evaluation test of hot lubricity and the plated steel sheet 10 was measured by the following method.

During the above evaluation test of hot lubricity, the drawing load was measured and the friction coefficient was calculated from the pressing load and the measured drawing load.

TABLE 2

| | | Plated | Die | | | | | Evaluation | | |
|---|---|---|---|---|---|---|---|---|---|---|
| Condition No. | Note | steel sheet | Base material | Nitride layer | PVD film | HV_Die (HV, 20° C.) | Rsk | Wear | Adhesion | Friction of coefficient |
| 1 | Comparative Example 1 | G1 | SKD61 | Absent | Absent | 550 | 1.3 | D | B | 0.51 |
| 2 | Example 1 | G2 | SKD61 | Present | Absent | 1200 | −0.18 | B | C | 0.56 |
| 3 | Example 2 | G1 | SKD61 | Present | Absent | 1200 | 0.21 | B | B | 0.45 |
| 4 | Example 3 | G3 | SKD61 | Present | Absent | 1200 | 0.15 | A | A | 0.4 |
| 5 | Example 4 | G1 | SKD61 | Present | CrN | 1550 | 0.8 | A | B | 0.38 |
| 6 | Example 5 | G3 | SKD61 | Present | CrN | 1550 | 0.8 | A | A | 0.35 |
| 7 | Example 6 | G1 | SKD61 | Present | TiN | 1800 | 0.8 | A | C | 0.52 |
| 8 | Example 7 | G3 | SKD61 | Present | TiN | 1800 | −0.88 | A | B | 0.41 |
| 9 | Comparative Example 2 | G1 | SKD61 | Present | TiAlN | 3400 | 0.8 | A | D | 0.6 |
| 10 | Comparative Example 3 | G2 | SKD61 | Present | AlCrN | 2970 | −0.62 | A | D | 0.58 |
| 11 | Comparative Example 4 | G3 | SKD61 | Present | CrAlN | 2700 | −0.32 | A | D | 0.59 |
| 12 | Comparative Example 5 | G1 | SKD61 | Present | AlCrN | 2970 | 1.6 | B | D | 0.62 |
| 13 | Comparative Example 6 | G2 | SKD61 | Present | AlCrN | 2970 | 0.5 | A | D | 0.6 |
| 14 | Comparative Example 7 | G1 | SKD61 | Absent | Absent | 550 | 0.31 | D | B | 0.5 |
| 15 | Example 8 | G3 | SKD61 | Present | CrN | 1550 | 0.03 | B | A | 0.33 |
| 16 | Example 9 | G1 | SKD61 | Present | TiN | 1800 | 0.06 | B | B | 0.45 |

Adhesion

The adhesion to the dies was evaluated by the following test.

The difference in surface profile between the steel sheet contact surface of the die in the apparatus for evaluating hot lubricity before the test for evaluating hot lubricity described above was performed and the steel sheet contact surface after the test for evaluating hot lubricity was performed was analyzed to measure the amount of adhesion on the die, the steel sheet contact surface being a surface that came into contact with (slid against) the plated steel sheet 10. Specifically, the profile of the die surface in the sliding portion was measured before and after sliding, using a contact-type shape measuring apparatus, to determine an adhesion height at a position at which the height of the adhered matter was largest (hereinafter, referred to as "maximum adhesion height on the die"). The maximum value of the measured adhesion heights on the upper die and the lower die was taken as the maximum adhesion height on the die.

The evaluation was performed based on the thus determined maximum adhesion height on the die, in accordance with the following evaluation criteria.

A: the maximum adhesion height on the die is 0.5 μm or less

B: the maximum adhesion height on the die is from more than 0.5 μm to 1 μm

From the results in Examples 1 to 9 shown in Table 2, it was confirmed that the wear on the sliding surface of a die can be reduced by forming a hard layer on the steel sheet contact surface of the die, the hard layer having a skewness (Rsk) in the sliding direction of from −5.0 to 1.2 and a hardness Hv_Die of from HV 1,000 to 1,800. Specifically, the wear on the sliding surface of the die was reduced in each of the Examples compared to Comparative Example 1, in which the skewness (Rsk) was 1.3 and the hardness Hv_Die is HV 550.

Adhesion was reduced in each of the Examples compared to Comparative Examples 2 to 6, in which Hv_Die exceeded HV 1,800.

Example B/Preparation of Press-Formed Product

<<Preparation of Die>>

A die was prepared in the same manner as that in Condition No. 1, 2, 3, 4, 5, 6, 7, 8, 10, 12, or 13 in the "Example A", except that the shape of the die was changed to a shape capable of producing a press-formed product illustrated in FIG. 2A and FIG. 2B and allowing the portion of the second ridge portion having the smallest curvature radius to have the minimum curvature radius [$R_{min}$] indicated in the following Table 3, and that the base material was replaced by a base material that exhibited the hardness Hv_Die value indicated in Table 3 at the vertical wall portion.

Here, the nitride layer and the PVD film were formed over the entirety of a region of the die at which contact between the die and the material were expected to occur.

<<Preparation of Press-Formed Product>>

Using each of the dies of the condition numbers indicated in Table 3, hot press forming was performed under the conditions including a furnace temperature set at 920° C., an in-furnace time of 5 minutes (in-furnace time of 6 minutes only for Formed Product No. 11), and a temperature at the start of forming of 700° C.

For each of the resulting press-formed products, the following properties were measured in accordance with the above-described methods: the curvature radius [$R_{min}$] at the portion of the second ridge portion having the smallest curvature radius; the average thickness of the ZnO layer; the smoothness [SaB1] at the central portion PB1$_{min}$, which is the central portion in the width direction of the top wall portion and which corresponds to the portion PB0$_{min}$ at which the curvature radius of the flange portion is smallest; the smoothness [SaB2] at the central portion PB2$_{min}$, which is the central portion in the height direction of the vertical wall portion and which corresponds to the portion PB0$_{min}$; the surface texture aspect ratio [StrB1] at the portion PB1$_{min}$ in the top wall portion; and the surface texture aspect ratio [StrB2] at the portion PB2$_{min}$ in the vertical wall portion.

Using each of the press-formed products shown in Table 3, the evaluations described below were performed.

<Evaluation>

Surface Quality of Vertical Wall Portion

For each of the resulting press-formed products with their respective formed product numbers, electrodeposition coating was performed to a film thickness of 15 and further, overcoating was performed to a film thickness of 20 Thereafter, the surface quality at the vertical wall portion of the resulting coated product was evaluated in accordance with the following criteria.

A: excellent surface quality (difference in glossiness<15, no flaws on the surface)

B: acceptable surface quality (15≤difference in glossiness<30, no flaws on the surface)

C: unacceptable surface quality (difference in glossiness≥30, no flaws on the surface)

D: having surface defects, and being unacceptable (with streak-like flaws on the product surface)

Difference in Glossiness

Glossiness was measured at the central portion PB1$_{min}$ and the central portion PB2$_{min}$. PB1$_{min}$ is the central portion in the width direction of the top wall portion, and, when observed from the side surface side, corresponds to the portion PB0$_{min}$ at which the curvature radius of the flange portion is smallest. The central portion PB2$_{min}$ is the central portion in the height direction of the vertical wall portion, and corresponds to the portion PB0$_{min}$ when observed from the side surface side. The glossiness at PB1$_{min}$ and the glossiness at PB2$_{min}$ were each measured by the following method, and the difference in glossiness between these two portions was calculated.

In the measurement of glossiness, a relative value of a reflectance was measured at an incident angle of light of 60°, assuming that the reflectance of a black mirrored glass having n value of 1.567 as defined in JIS Z 8741 is 100.

TABLE 3

| | | | Formed product | | | | | | | | | Evaluation | |
|---|---|---|---|---|---|---|---|---|---|---|---|---|---|
| Formed product No. | Condition No. | Plated steel sheet | Minimum curvature radius [$R_{min}$] (mm) | HV_Die of vertical wall portion of base material (HV, 20° C.) | ZnO layer thickness (μm) | Smoothness of top wall portion [SaB1] (μm) | Smoothness of vertical wall portion [SaB2] (μm) | [SaB1-SaB2] | Surface texture aspect ratio of top wall portion [StrB1] | Surface texture aspect ratio of vertical wall portion [StrB2] | [StrB1-StrB2] | Difference in glossiness | Product evaluation |
| 1 | 1 | G1 | 10 | 450 | 0.1 | 2.07 | 1.93 | 0.14 | 0.82 | 0.77 | 0.05 | 14 | A |
| 2 | 1 | G1 | 5 | 450 | 0.1 | 2.12 | 1.72 | 0.40 | 0.85 | 0.21 | 0.64 | 30 | C |
| 3 | 10 | G2 | 8 | 450 | 0.06 | 2.23 | 1.42 | 0.81 | 0.89 | 0.09 | 0.80 | 52 | D |
| 4 | 10 | G2 | 3 | 450 | 0.06 | 2.23 | 1.22 | 1.01 | 0.86 | 0.03 | 0.83 | 55 | D |
| 5 | 2 | G2 | 8 | 450 | 0.1 | 2.17 | 1.64 | 0.53 | 0.88 | 0.68 | 0.20 | 15 | B |
| 6 | 3 | G1 | 5 | 450 | 0.1 | 2.07 | 1.55 | 0.52 | 0.84 | 0.48 | 0.36 | 17 | B |
| 7 | 4 | G3 | 3 | 450 | 0.3 | 2.18 | 1.29 | 0.89 | 0.85 | 0.59 | 0.26 | 14 | A |
| 8 | 5 | G1 | 8 | 300 | 0.1 | 2.02 | 1.67 | 0.35 | 0.9 | 0.68 | 0.22 | 8 | A |
| 9 | 6 | G3 | 8 | 550 | 0.3 | 2.23 | 1.65 | 0.58 | 0.86 | 0.72 | 0.14 | 6 | A |
| 10 | 7 | G1 | 8 | 650 | 0.1 | 2.12 | 1.62 | 0.50 | 0.83 | 0.61 | 0.22 | 14 | A |
| 11 | 8 | G3 | 5 | 450 | 0.6 | 2.16 | 1.7 | 0.46 | 0.84 | 0.66 | 0.18 | 12 | A |
| 12 | 12 | G1 | 3 | 450 | 0.05 | 2.06 | 1.45 | 0.61 | 0.83 | 0.07 | 0.76 | 45 | C |
| 13 | 13 | G2 | 5 | 450 | 0.1 | 2.17 | 1.51 | 0.66 | 0.87 | 0.19 | 0.68 | 30 | D |

Formed Product No. 1

In Formed Product No. 1, the minimum curvature radius [$R_{min}$] at the second ridge portion was large. Thus, it is considered that a low surface pressure was applied to the vertical wall portion, resulting in a small difference in smoothness [SaB1−SaB2].

Formed Products Nos. 2 to 4, 12, and 13

In each of the Formed Products Nos. 2 to 4, 12, and 13, the minimum curvature radius [$R_{min}$] at the second ridge portion was small. Thus, it is considered that a higher surface pressure was applied to the vertical wall portion, resulting in a larger difference in smoothness [SaB1−SaB2].

In the hot press forming performed using a die which satisfies at least one of the condition that the skewness (Rsk) was more than 1.2 or the condition that the hardness Hv_Die was less than HV 1,000, and in the hot press forming performed using a die which satisfies the condition that the hardness Hv_Die was more than HV 1,800, plating adhesion to the die occurred and caused scratches on the vertical wall portion. As a result, the surface texture aspect ratio [StrB2], which is a parameter indicating an anisotropy of surface state, of the vertical wall portion significantly decreased to a value close to 0.

Further, since there was a difference in the degree of reflection of light between the ZnO layer and the scratched portion of the vertical wall portion, the difference in glossiness increased.

Formed Products Nos. 5 to 7

In each of the Formed Products Nos. 5 to 7, the minimum curvature radius [$R_{min}$] at the second ridge portion was small. Thus, it is considered that a high surface pressure was applied to the vertical wall portion, resulting in a large difference in smoothness [SaB1−SaB2].

However, in the hot press forming performed using a die which satisfies both of the condition that the skewness (Rsk) was 1.2 or less and the condition that the hardness Hv_Die was from HV 1,000 to HV 1,800, the occurrence of scratches on the vertical wall portion was reduced, and a decrease in the surface texture aspect ratio [StrB2], which is a parameter indicating an anisotropy of the surface state, of the vertical wall portion was also reduced.

As a result, the difference in glossiness between the vertical wall portion and the top wall portion was small.

Formed Products No. 8 to 10

These are examples in which base materials for press-formed products have different strengths.

Formed Product No. 11

This is an example in which the thickness (average thickness) of the ZnO layer is thick.

Preferable embodiments of the present disclosure have been described above in detail, with reference to accompanying drawings. It is needless to say, however, that the present disclosure is not limited to the foregoing examples. Apparently, a person having ordinary knowledge in the technical field to which the present disclosure belongs is able to conceive various changes and modifications within the scope of the technical idea described in the claims, and these changes and modifications also understandably belong to the technical scope of the present disclosure.

The evaluation of delayed fracture was performed by the cathodic hydrogen charging test method (reference document: Tomohiko Omura et al.: Iron and Steel, Vol. 100, No. 10, 2014, pp. 1289) for 48 hours of retention time under the condition in which hydrogen in the steel saturated. The presence or absence of cracks on the surface of the vertical wall portion of the formed products was observed, and the evaluation result of Formed Product No. 7 was "no cracks were found", whereas the evaluation result of the Formed Product No. 3 was "cracks were found".

REFERENCE SIGNS LIST

The explanations of the reference signs are provided below.

10 Plated steel sheet
11, 111 Die
11A, 111A Steel sheet contact surface
11B, 111B Die shoulder portion
11C, 111C Hard layer
11D, 111D Die hole
12 Holder (steel blank holder)
12C Second hard layer
13 Punch
30, 40, 50 Hot press-formed product
31, 41, 51 Top wall portion
32, 42, 52*a*, 52*b* First ridge portion
33, 43, 53*a*, 53*b* Vertical wall portion
34, 44, 54*a*, 54*b* Second ridge portion
35, 45, 55*a*, 55*b* Flange portion
100 Near-infrared furnace
102A Upper die
102B Lower die
112 Steel sheet
113 Punch
113C Second hard layer
114A, 114B GA plating layer
116A, 116B Zinc compound layer or metallic zinc layer The disclosure of Japanese Patent Application No. 2018-127892 is incorporated herein by reference in its entirety.

All publications, patent applications, and technical standards mentioned in the present specification are incorporated herein by reference to the same extent as if each individual publication, patent application, or technical standard was specifically and individually indicated to be incorporated by reference.

The invention claimed is:

1. A method of producing a hot press-formed product, the method comprising:

placing a hot-dip galvannealed steel sheet, comprising a hot-dip galvannealed layer, on a die so as to block a die hole of the die, and hot press-forming the hot-dip galvannealed steel sheet using the die, wherein the die comprises a hard layer having a skewness (Rsk), as measured in a direction from an outside of the die hole toward an inside of the die hole, of from −5.0 to 1.2, and a hardness Hv_Die of from HV 1,000 to 1,800, over an entirety of a region of a steel sheet contact surface that is adjacent to a die shoulder portion, the steel sheet contact surface being located outside of the die hole and being configured to contact the hot-dip galvannealed steel sheet that is to be subjected to the hot press forming; and wherein the hard layer comprises a nitride steel layer as an outermost layer, and the nitride steel layer is a nitrided layer of a base material of the die, wherein the base material of the die is a steel.

2. The method of producing the hot press-formed product according to claim 1, wherein the hot-dip galvannealed steel sheet comprises a zinc compound layer or a metallic zinc layer as an outermost layer on the hot-dip galvannealed layer.

3. The method of producing the hot press-formed product according to claim 1, wherein the skewness (Rsk) of the hard layer, as measured in a direction from an outside of the die hole toward an inside of the die hole, is from 0.03 to 1.2.

4. A die, comprising a hard layer having a skewness (Rsk), as measured in a direction from an outside of a die hole toward an inside of the die hole, of from −5.0 to 1.2, and a hardness Hv_Die of from HV 1,000 to 1,800, over an entirety of a region of a die shoulder adjacent surface that is adjacent to a die shoulder portion, the die shoulder adjacent surface being located outside of the die hole and adjacent to the die shoulder portion; and wherein the hard layer comprises a nitride steel layer as an outermost layer, and the nitride steel layer is a nitrided layer of a base material of the die, wherein the base material of the die is a steel.

5. A die set, comprising the die according to claim 4, and a punch, wherein the punch comprises a second hard layer having a skewness (Rsk), as measured in a direction from an outside of a punch portion toward an inside of the punch portion, of from −5.0 to 1.2, and a hardness Hv_Die of from HV 1,000 to 1,800, over an entirety of a region of a facing surface that faces the region of the die provided with the hard layer, the facing surface facing the die shoulder adjacent surface of the die.

6. The die set according to claim 5, wherein the second hard layer comprises a second nitride steel layer as an outermost layer, and the second nitride steel layer is a nitrided layer of a base material of the punch, wherein the base material of the punch is a steel, and wherein the die set is used for hot press forming.

7. The die set according to claim 5, wherein the skewness (Rsk) of the second hard layer, as measured in a direction from an outside of a punch portion toward an inside of the punch portion, is from 0.03 to 1.2, and wherein the die set is used for hot press forming.

8. A die set, comprising the die according to claim 4, and a steel blank holder, wherein the steel blank holder comprises a second hard layer having a skewness (Rsk), as measured in a direction from an outside of a punch-insertion portion toward an inside of the punch-insertion portion, of from −5.0 to 1.2, and a hardness Hv_Die of from HV 1,000 to 1,800, over an entirety of a region of a facing surface that faces the region of the die provided with the hard layer, the facing surface facing the die shoulder adjacent surface of the die.

9. The die set according to claim 8, wherein the second hard layer comprises a second nitride steel layer as an outermost layer, and the second nitride steel layer is a nitrided layer of a base material of the steel blank holder, wherein the base material of the steel blank holder is a steel, and wherein the die set is used for hot press forming.

10. The die set according to claim 8, wherein the skewness (Rsk) of the second hard layer, as measured in a direction from an outside of a punch-insertion portion toward an inside of the punch-insertion portion, is from 0.03 to 1.2, and wherein the die set is used for hot press forming.

11. The die according to claim 4, wherein the skewness (Rsk) of the hard layer, as measured in a direction from an outside of a die hole toward an inside of the die hole, is from 0.03 to 1.2, and wherein the die is used for hot press forming.

* * * * *